US005114822A

United States Patent [19]

Kato et al.

[11] Patent Number: 5,114,822

[45] Date of Patent: May 19, 1992

[54] LIQUID DEVELOPER FOR ELECTROSTATIC PHOTOGRAPHY

[75] Inventors: Eiichi Kato; Hideyuki Hattori, both of Shizuoka, Japan

[73] Assignee: Fuji Photo Film Co., Ltd., Kanagawa, Japan

[21] Appl. No.: 647,110

[22] Filed: Jan. 29, 1991

[30] Foreign Application Priority Data

Jan. 31, 1990 [JP] Japan ..... 2-18949
Jun. 13, 1990 [JP] Japan ..... 2-152537
Jun. 13, 1990 [JP] Japan ..... 2-152538

[51] Int. Cl.[5] ..... G03G 9/12
[52] U.S. Cl. ..... 430/114; 430/115
[58] Field of Search ..... 430/904, 114, 115

[56] References Cited

U.S. PATENT DOCUMENTS 4,522,908 6/1985 de Winter et al. ..... 430/114
4,665,002 5/1987 Dan et al. ..... 430/114
4,837,102 6/1989 Dan et al. ..... 430/114

FOREIGN PATENT DOCUMENTS 0333497 9/1989 European Pat. Off. .

OTHER PUBLICATIONS

Patent Abstracts of Japan, vol. 14, No. 162 (Mar. 29, 1990).
Patent Abstracts of Japan, vol. 14, No. 158 (Mar. 27, 1990).

*Primary Examiner*—Marion E. McCamish
*Assistant Examiner*—Rosemary Ashton
*Attorney, Agent, or Firm*—Sughrue, Mion, Zinn, Macpeak & Seas

[57] ABSTRACT

A liquid developer for electrostatic photography is disclosed. The liquid developer comprises at least resin grains dispersed in a non-aqueous solvent having an electric resistance of at least $10^9$ cm and a dielectric constant of not higher than 3.5, wherein the dispersed resin grains are copolymer resin grains obtained by polymerizing a solution containing (1) at least a monofunctional monomer (A) which is soluble in the above-described non-aqueous solvent but becomes insoluble therein by being polymerized, and, optionally, a monomer (B-1) represented by the formula (III) or a monomer (B-2) represented by the formula (IV), in the presence of a dispersion-stabilizing resin soluble in the non-aqueous solvent, which is an AB type block copolymer. The liquid developer of the present invention is excellent in re-dispersibility, storability, stability, image-reproducibility, and fixability, and provide a master plate for offset printing having high printing durability.

10 Claims, No Drawings

LIQUID DEVELOPER FOR ELECTROSTATIC PHOTOGRAPHY

FIELD OF THE INVENTION

This invention relates to a liquid developer for electrostatic photography, which comprises resin grains dispersed in a liquid carrier having an electric resistance of at least $10^9$ Ωcm and a dielectric constant of not higher than 3.5, and more particularly to an electrophotographic liquid developer excellent in re-dispersibility, storability, stability, image-reproducibility, and fixability.

BACKGROUND OF THE INVENTION

In general, a liquid developer for electrophotography is prepared by dispersing an inorganic or organic pigment or dye such as carbon black, nigrosine, phthalocyanine blue, etc., a natural or synthetic resin such as an alkyd resin, an acrylic resin, rosine, synthetic rubber, etc., in a liquid having a high electric insulating property and a low dielectric constant, such as a petroleum aliphatic hydrocarbon, etc., and further adding a polarity-controlling agent such as a metal soap, lecithin, linseed oil, a higher fatty acid, a vinyl pyrrolidone-containing polymer, etc., to the resulting dispersion.

In such a developer, the resin is dispersed in the form of insoluble latex grains having a grain size of from several nm to several hundred nm. In a conventional liquid developer, however, a soluble dispersion-stabilizing resin added to the liquid developer and the polarity-controlling agent are insufficiently bonded to the insoluble latex grains, thereby the soluble dispersion-stabilizing resin and the polarity-controlling agent are in a state of easily dispersing in the liquid carrier. Accordingly, there is a fault that when the liquid developer is stored for a long period of time or repeatedly used, the dispersion-stabilizing resin is split off from the insoluble latex grains, thereby the latex grains are precipitated, aggregated, and accumulated to make the polarity thereof indistinct. Also, since the latex grains once aggregated or accumulated are reluctant to re-disperse, the latex grains remain everywhere in the developing machine attached thereto, which results in causing stains of images formed and malfunctions of the developing machine, such as clogging of a liquid feed pump, etc.

For overcoming such defects, a means of chemically bonding the soluble dispersion-stabilizing resin and the insoluble latex grains is disclosed in U.S. Pat. No. 3,990,980. However, the liquid developer disclosed therein is still insufficient although the dispersion stability of the grains to the spontaneous precipitation may be improved to some extent. Also, when the liquid developer is actually used in a developing apparatus, the toner adhered to parts of the developing apparatus solidified to form a film and the toner grains thus solidified are reluctant to re-disperse and are insufficient in re-dispersion stability for practical use, which causes the malfunction of the apparatus and staining of duplicated images.

In the method of producing resin grains described in aforesaid U.S. Pat. No. 3,990,980, there is a very severe restriction in the combination of a dispersion stabilizer to be used and monomer(s) being insolubilized for producing mono-dispersed latex grains having a narrow grain size distribution. Mostly, the resin grains produced by the aforesaid method are grains of a broad grain size distribution containing a large amount of coarse grains or poly-dispersed grains having two or more different mean grain sizes. In the aforesaid method, it is difficult to obtain mono-dispersed resin grains having a narrow grain size distribution and having a desired grain size, and the method often results in forming large grains having a mean grain size of 1 μm or larger or very fine grains having a mean grain size of 0.1 μm or smaller. Furthermore, there is also a problem that the dispersion stabilizer used must be prepared by an extremely complicated process requiring a long reaction time.

Furthermore, for overcoming the aforesaid defects, a method for improving the dispersibility, re-dispersibility and storage stability of resin grains by forming insoluble dispersed resin grains by copolymerizing a monomer being insolubilized with a monomer containing a long chain alkyl group or a monomer containing at least two polar groups as disclosed in JP-A-60-179751 and JP-A-62-151868 (the term "JP-A" as used herein means an "unexamined published Japanese patent application"). Also, a method for improving the dispersibility, re-dispersibility and storage stability of resin grains by forming insoluble dispersed resin grains by copolymerizing a monomer being insolubilized with a monomer containing a long chain alkyl group or a monomer containing at least two polar groups in the presence of a polymer utilizing a di-functional monomer or a polymer utilizing a macromolecular reaction is disclosed in JP-A-60-185963, JP-A-61-63855, JP-A-62-166362 and JP-A-63-66567.

On the other hand, an attempt has recently been made to print a large number of prints such as more than 5,000 prints using a master plate for offset printing by electrophotography, and, as a result of improvement particularly in the master plate, it has become possible to print more than 10,000 prints of large size. Also, a noticiable progress has recently been made in shortening the operation time in an electrophotomechanical system and an improvement of quickening a development-fix steps in the system has been made.

Also, the rationalization of an electrophotomechanical system has been greatly required and practically, it has been attempted to prolong the maintenance time of a printing plate making machine. In this attempt, a liquid developer which can be used for a long period of time without being renewed has been required.

The dispersed resin grains produced by the methods disclosed in JP-A-60-179751, JP-A 62-151868, JP-A-62-166362 and JP-A-63-66567 yet show an unsatisfactory performance with respect to the dispersibility and re-dispersibility of the resin grains when the resin grains are used at a long interval of maintenance or the development speed is increased. Also, these resin grains show an unsatisfactory performance with respect to the dispersibility and re-dispersibility of the resin grains and the printing durability of plates obtained by the development with a liquid developer containing such resin grains.

In particular, there has been a problem in the improvement of re-dispersibility of the dispersed resin grains when the plate processing operation is improved by prolonging the interval of maintenance of the plate processing machine, or when the image quality of the reproduced image is improved in case of using a large size plate-making machine for a large size master plate (e.g., a size larger than A-3) without causing stains of the developing machine.

SUMMARY OF THE INVENTION

The present invention has been made for solving the above-described problems inherent to conventional electrophotographic liquid developers.

An object of the present invention is to provide a liquid developer excellent in dispersion stability, re-dispersibility, and fixing property in an electrophotomechanical system wherein development-fix steps are quickened and the interval of maintenance thereof is prolonged.

Another object of the present invention is to provide a liquid developer excellent in dispersion stability, re-dispersibility, and fixing property in an electrophotomechanical system wherein development-fix steps are quickened and master plates of large sizes are processed.

Still another object of the present invention is to provide a liquid developer capable of forming an offset printing master plate having excellent receptivity for printing ink and printing durability by an electrophotography.

A further object of the present invention is provide a liquid developer suitable for various electrostatic photographies and various transfer systems in addition to the above-described uses.

A still further object of the present invention is to provide a liquid developer capable of being used for any liquid developer-using systems such as ink jet recording, cathode ray tube recording, and recording by pressure variation or electrostatic variation.

The above-described objects have been attained by the present invention as described hereinafter in detail.

That is, the present invention provides a liquid developer for electrostatic photography comprising at least resin grains dispersed in a non-aqueous solvent having an electric resistance of at least $10^9$ Ωcm and a dielectric constant of not higher than 3.5, wherein the dispersed resin grains are polymer resin grains obtained by polymerizing a solution containing at least a mono-functional monomer (A) which is soluble in the above-described non-aqueous solvent but becomes insoluble therein by being polymerized, in the presence of a dispersion stabilizing resin soluble in the non-aqueous solvent, which is an AB block copolymer having a weight average molecular weight from $1\times10^4$ to $5\times10^5$ composed of an A block containing at least a polymer component represented by the general formula (I) described below and a B block comprising a polymer component containing at least one polar group selected from a carboxy group, a sulfo group, a hydroxyl group, a formyl group, an amino group, a phosphono group and a

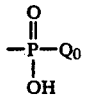

group (wherein $Q_0$ represents $-Q_1$ or $-OQ_1$ (wherein $Q_1$ represents a hydrocarbon group)) and/or a polymer component corresponding to the monofunctional monomer (A);

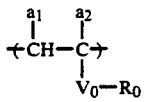

(I)

wherein $V_0$ represents —COO—, —OCO—, $-(CH_2)_l-COO-$, $-(CH_2)_l-OCO-$ or —O— (wherein l represents an integer of from 1 to 3), $R_0$ represents an aliphatic group having 10 or more carbon atoms, and $a_1$ and $a_2$, which may be the same or different, each represents a hydrogen atom, a halogen atom, a cyano group, a hydrocarbon group, —COO— $D_1$ or —COO—$D_1$ bonded via a hydrocarbon group (wherein $D_1$ represents a hydrogen atom or a hydrocarbon group which may be substituted).

In a preferred embodiment of the present invention, the dispersed resin grains contained in the liquid developer are produced by copolymerizing a solution containing at least the monofunctional monomer (A) and at least one monomer (B-1) represented by the formula (III) having at least two polar groups and/or polar linkage groups hereinafter described in detail, or at least one monomer (B-2) represented by the formula (IV) having an aliphatic group having at least 8 carbon atoms hereinafter described in detail, in the presence of a dispersion-stabilizing resin composed of the AB block copolymer.

DETAILED DESCRIPTION OF THE INVENTION

Then, the liquid developer of the present invention is described in detail.

As the liquid carrier for the liquid developer of the present invention having an electric resistance of at least $10^9$ Ωcm and a dielectric constant of not higher than 3.5, straight chain or branched aliphatic hydrocarbons, alicyclic hydrocarbons, aromatic hydrocarbons, and halogen-substituted derivatives thereof can be used. Examples of liquid carrier include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 solvent (Amsco: trade name of Americal Mineral Spirits Co.). They may be used singly or as a combination thereof.

The non-aqueous dispersed resin grains (hereinafter often referred to as "dispersion resin grains" or "latex grains") which are the most important constituting element in this invention are resin grains produced by polymerizing (so-called polymerization granulation method), in a non-aqueous solvent, the above-described monofunctional monomer (A) and, optionally, the monomer (B 1) or (B-2), in the presence of a dispersion-stabilizing resin soluble in the non-aqueous solvent, said dispersion-stabilizing resin being a AB type copolymer.

As the non-aqueous solvent for use in the present invention, any solvents miscible with the above-described liquid carrier for the liquid developer for electrostatic photography can be basically used in the present invention.

That is, the non-aqueous solvent used in the production of the dispersion resin grains may be any solvent miscible with the above-described liquid carrier, and preferably includes straight chain or branched aliphatic hydrocarbons, alicyclic hydrocarbons, aromatic hydrocarbons, and halogen-substituted derivatives thereof.

Specific examples thereof are hexane, octane, isooctane, decane, isodecane, decalin, nonane, dodecane, isododecane, Isopar E, Isopar G, Isopar H, Isopar L, Shellsol 70, Shellsol 71, Amsco OMS, and Amsco 460.

These solvents may be used singly or as a combination thereof.

Other solvents can be used together with the above-described organic solvents for the production of the non-aqueous dispersion resin grains and examples thereof include alcohols (e.g., methanol, ethanol, propyl alcohol, butyl alcohol, and fluorinated alcohols), ketones (e.g., acetone, methyl ethyl ketone, and cyclohexanone), carboxylic acid esters (e.g., methyl acetate, ethyl acetate, propyl acetate, butyl acetate, methyl propionate, and ethyl propionate), ethers (e.g., diethyl ether, dipropyl ether, tetrahydrofuran, and dioxane), and halogenated hydrocarbons (e.g., methylene dichloride, chloroform, carbon tetrachloride, dichloroethane, and methylchloroform).

It is preferred that the non-aqueous solvents which are used as a mixture thereof are distilled off by heating or under a reduced pressure after completion of the polymerization granulation. However, even when the solvent is brought in the liquid developer as a latex grain dispersion, the solvent gives no problem if the liquid electric resistance of the liquid developer is in the range of satisfying the condition of at least $10^9$ Ωcm.

In general, it is preferred that the same solvent as the liquid carrier is used in the step of forming the resin dispersion and, such solvents include straight chain or branched aliphatic hydrocarbons, alicyclic hydrocarbons, aromatic hydrocarbons, halogenated hydrocarbons, etc., as described above.

The monofunctional monomer (A) used in the present invention may be a monofunctional monomer which is soluble in the non-aqueous solvent but becomes insoluble by being polymerized.

Practical examples of the monomer include the monomers represented by the following formula (II);

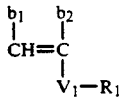

(II)

wherein $V_1$ represents $-COO-$, $-OCO-$, $-CH_2OCO-$, $-CH_2COO-$, $-O-$, $-CONHCOO-$, $-CONHOCO-$, $-SO_2-$,

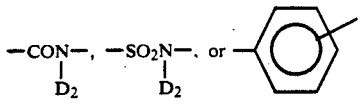

(wherein $D_2$ represents a hydrogen atom or an aliphatic group having from 1 to 8 carbon atoms which may be substituted (e.g., methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, fluorobenzyl, 2-methoxyethyl, and 3-methoxypropyl).

$R_1$ in the above formula represents an aliphatic group having from 1 to 6 carbon atoms which may be substituted (e.g., methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxypropyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridiylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl, and dichlorohexyl).

Also, in the above formula (II), $b_1$ and $b_2$, which may be the same or different, each represents the same group as $a_1$ or $a_2$ in formula (I).

Specific examples of the monofunctional monomer (A) are vinyl esters or allyl esters of an aliphatic carboxylic acid having from 1 to 6 carbon atoms (e.g., acetic acid, propionic acid, butyric acid, monochloroacetic acid, and trifluoropropionic acid); alkyl esters or alkyl amides (said alkyl having from 1 to 4 carbon atoms, which may be substituted) of an unsaturated carboxylic acid such as acrylic acid, methacrylic acid, crotonic acid, itaconic acid, maleic acid, etc. (examples of the alkyl group are methyl, ethyl, propyl, butyl, 2-chloroethyl, 2-bromoethyl, 2- fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)-ethyl, 2-(N,N-diethylamino)ethyl, 2-carboxyethyl, 2-phosphoethyl, 4-carboxybutyl, 3-sulfopropyl, 4-sulfobutyl. 3-chloropropyl, 2-hydroxy-3-chloropropyl, 2-furfurylethyl, 2-pyridinylethyl, 2-thienylethyl, trimethoxysilylpropyl, and 2-carboxyamidoethyl); styrene derivatives (e.g., styrene, vinyltoluene, α-methylstyrene, vinylnaphthalene, chlorostyrene, dichlorostyrene, bromostyrene, vinylbenzenecarboxylic acid, vinylbenzenesulfonic acid, chloromethylstyrene, hydroxymethylstyrene, methoxymethylstyrene, N,N-dimethylaminomethylstyrene, vinylbenzenecarbcxyamide, and vinylbenzenesulfoamide); unsaturated carboxylic acids such as acrylic acid, methacrylic acid, crotonic acid, maleic acid, itaconic acid, etc.; cyclic anhydrides of maleic acid and itaconic acid; acrylonitrile; methacrylonitrile; and heterocyclic compounds having a polymerizable double bond (practically the compounds described in *Kobunshi* (*Macromolecular*) *Data Handbook* (*Foundation*), pages 175–184, edited by Kobunshi Gakkai, published by Baihukan, 1986, such as, for example, N-vinylpyridine, N-vinylimidazole, N-vinylpyrrolidone, vinylthiophene, vinyltetrahydrofuran, vinyloxazoline, vinylthiazole, and N-vinylmorpholine).

The monomers (A) may be used singly or as a combination thereof.

According to a preferred embodiment of the present invention, the dispersion resin grains used in the present invention are obtained by polymerizing a monomer (B-1) having at least two polar groups and/or polar linkage groups together with the mono-functional monomer (A) which is soluble in the above-described non-aqueous solvent but becomes insoluble by being polymerized.

The liquid developer for electrostatic photography according to the above described embodiment of the present invention has, by the use of the monomer (B-1) together with the mono-functional monomer (A), the feature that the developer has an excellent fixing property while keeping the good re-dispersibility.

Practical examples of the monomer (B-1) having at least two polar groups and/or polar linkage groups are monomers represented by following formula (III)

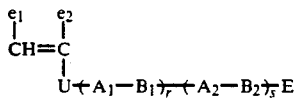

(III)

wherein U represents

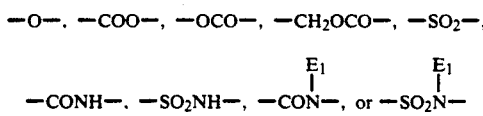

(wherein $E_1$ represents a hydrocarbon group or has the same meaning as the bonding group, $-(A_1-B_1)_r-(A_2-B_2)_s-E$ in the above-described formula (III); E represents a hydrocarbon group having from 1 to 18 carbon atoms, which may be substituted with a halogen atom, —OH, —CN, $-NH_2$, —COOH, $-SO_3H$, or $-PO_3H_2$; $B_1$ and $B_2$, which may be the same or different, each represents

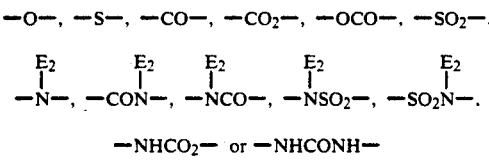

(wherein $E_2$ has the same meaning as E described above); $A_1$ and $A_2$, which may be the same or different, each represents a hydrocarbon group having from 1 to 18 carbon atoms which may be substituted or may contain

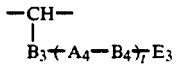

(wherein $B_3$ and $B_4$, which may be the same or different, have the same meaning as $B_1$ and $B_2$ described above; $A_4$ represents a hydrocarbon group having from 1 to 18 carbon atoms, which may be substituted; and $E_3$ has the same meaning as E) in the main chain bond; $e_1$ and $e_2$, which may be the same or different, each represents a hydrogen atom, a hydrocarbon group, $-COO-E_4$ or $-COO-E_4$ bonded via a hydrocarbon group (wherein $E_4$ represents a hydrogen atom or a hydrocarbon group which may be substituted); and r, s and t, which may be the same or different, each represents an integer of from 0 to 4, provided that r, s and t cannot be 0 at the same time.

Then, the monomer (B-1) shown by formula (III) used in the present invention is described in more detail.

In formula (III), U represents preferably

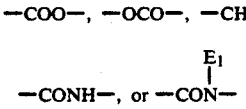

(wherein $E_1$ represents preferably an alkyl group having from 1 to 16 carbon atoms, which may be substituted, an alkenyl group having from 2 to 16 carbon atoms, which may be substituted, an alicyclic group having from 5 to 18 carbon atoms, which may be substituted, or has the same meaning as the bonding group, $-(A_1-B_1)_r-(A_2-B_2)_s-E$ in formula (111)).

E represents preferably a hydrogen atom or an aliphatic group having from 1 to 16 carbon atoms, which may be substituted with a halogen atom (e.g., chlorine and bromine), —OH, —CN, or —CCOH (examples of the aliphatic group include an alkyl group, an alkenyl group, and an aralkyl group).

$B_1$ and $B_2$, which may be the same or different, each represents preferably

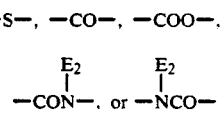

(wherein $E_2$ each has the same meaning as E described above).

$A_1$ and $A_2$, which may be the same or different, each represents a hydrocarbon group having from 1 to 12 carbon atoms (examples of the hydrocarbon group are an alkylene group, an alkenylene group, an arylene group and a cycloalkylene group) which may be substituted or or may contain

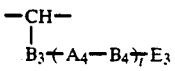

(wherein $B_3$ and $B_4$, which may be the same or different, have the same meaning as $B_1$ and $B_2$ described above; $A_4$ represents preferably an alkylene group having from 1 to 12 carbon atoms, an alkenylene group, or an arylene group, each group may be substituted; and $E_3$ has the same meaning as E described above) in the main chain bond thereof.

Also, $e_1$ and $e_2$, which may be the same or different, each represents preferably a hydrogen atom, a methyl group, $-COO-E_4$, or $-CH_2COO-E_4$ (wherein $E_4$ represents preferably a hydrogen atom, an alkyl group having from 1 to 18 carbon atoms, an alkenyl group, an aralkyl group or a cycloalkyl group).

Furthermore, r, s, and t, which may be the same or different, each represents preferably an integer of from 0 to 3, provided that r, s and t cannot be 0 at the same time.

Furthermore, more preferably, in formula (III), U represents

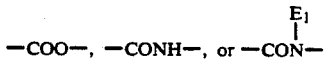

and $e_1$ and $e_2$, which may be the same or different, each represents a hydrogen atom, a methyl group $-COO-E_4$, or $-CH_2COO-E_4$ (wherein $E_4$ represents preferably an alkyl group having from 1 to 12 carbon atoms).

Also, specific examples of $A_1$ and $A_2$ are composed of an optional combination of atomic groups such as

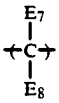

(wherein $E_7$ and $E_8$ each represents a hydrogen atom, an alkyl group, or a halogen atom),

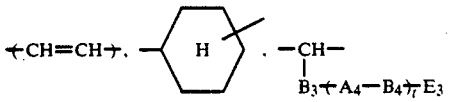

(wherein $B_3$, $B_4$, $E_3$, $A_4$, and t have the same meaning as described above), etc.

Also, in the bonding group $$\overset{|}{U}\text{-}(A_1\text{-}B_1)_r\text{-}(A_2\text{-}B_2)_s\text{-}E$$

in the formula (III), it is preferred that the linkage main chain composed of U, $A_1$, $B_1$, $A_2$, $B_2$, and E has a total number of atoms at least 8. In this case, when U represents $$\text{-}\overset{E_1}{\overset{|}{C}}\text{O}\text{-} \quad \text{or} \quad \text{-}SO_2\overset{E_1}{\overset{|}{N}}\text{-}$$

and $E_1$ represents $\text{-}(A_1\text{-}B_1)_r(A_2\text{-}B_2)_sE$, the linkage main chain composed by $E_1$ is included in the above-described linkage main chain. Furthermore, $B_3\text{-}(A_4\text{-}B_4)_tE_3$, in the case where $A_1$ or $A_2$ represents the hydrocarbon group having $$\text{-}\underset{\underset{B_3\text{-}(A_4\text{-}B_4)_t\text{-}E_3}{|}}{CH}\text{-}$$

in the main chain bond is also included in the above-described linkage main chain.

As to the number of atoms of the linkage main chain, when, for example, V represents —COO— or —CONH— the oxo group (=O) and the hydrogen atom are not included in the number of atoms but the carbon atom(s), ether-type oxygen atom, and nitrogen atom each constituting the linkage main chain are included in the number of atoms. Thus, the number of atoms of —COO— and —CONH— is counted as 2. Also, when, for example, E represents $-C_9H_{19}$, the hydrogen atoms are not included in the number of atoms and the carbon atoms are included therein. Thus, the number of atoms in this case is counted as 9.

Specific examples of the monomer (B-1) represented by formula (III) are illustrated below.

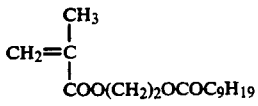

(III-1)

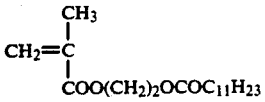

(III-2)

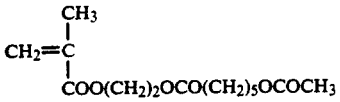

(III-3)

-continued

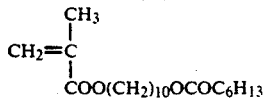

(III-4)

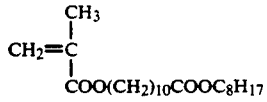

(III-5)

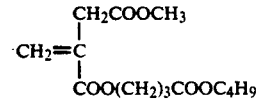

(III-6)

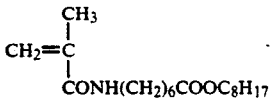

(III-7)

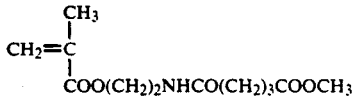

(III-8)

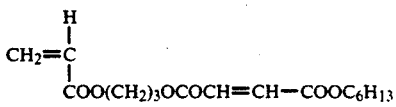

(III-9)

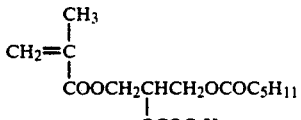

(III-10)

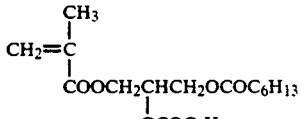

(III-11)

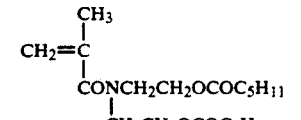

(III-12)

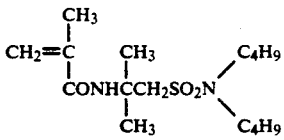

(III-13)

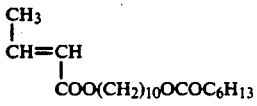

(III-14)

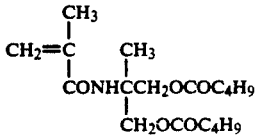

(III-15)

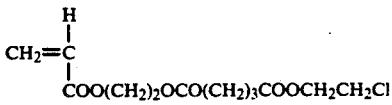

(III-16)

-continued (III-17)

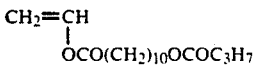

(III-18)

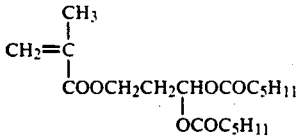

(III-19)

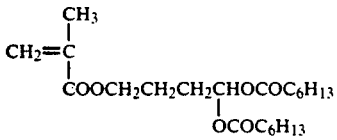

(III-20)

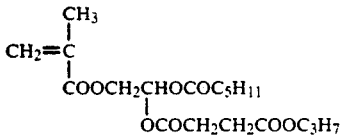

(III-21)

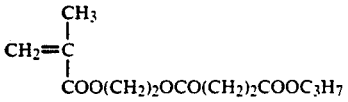

(III-22)

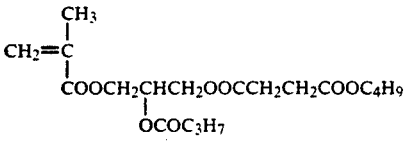

(III-23)

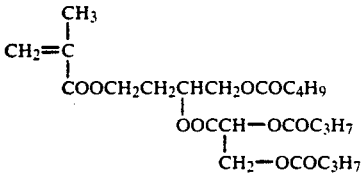

(III-24)

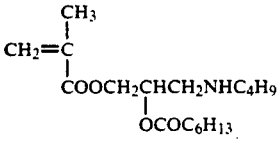

(III-25)

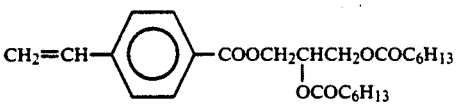

(III-26)

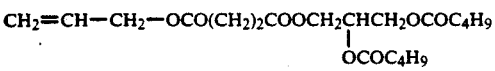

(III-27)

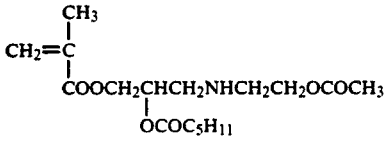

(III-28)

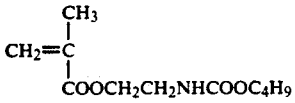

-continued (III-29)

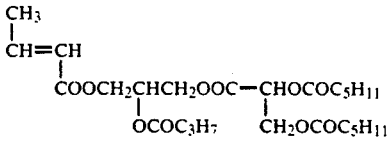

According to the above-described embodiment of the present invention, the dispersion resin grains are composed of at least one kind of the monomer (A) and at least one kind of the monomer (B-1), and it is important that the desired dispersion resin grains can be obtained if the resin produced from these monomers is insoluble in the non-aqueous solvent. More practically, in the above-described case, the proportion of the monomer (B-1) shown by formula (III) is preferably from 0.1 to 10% by weight, and more preferably from 0.2 to 8% by weight based on the amount of the monomer (A) being insolubilized. Also, the molecular weight of the dispersion resin grains is from $1\times10^3$ to $1\times10^6$, and more preferably from $1\times10^4$ to $1\times10^6$.

According to another preferred embodiment of the present invention, the dispersion resin grains used in the present invention are copolymer resin grains produced by copolymerizing a monomer (B-2) having an aliphatic group having 8 or more carbon atoms in combination with the functional monomer (A) which is soluble in the above-described non-aqueous solvent but becomes insoluble therein by being polymerized.

The liquid developer for electrostatic photography according to the above described embodiment has the feature of very excellent re-dispersibility owing to the use of the monomer (B-2) in addition to the monofunctional monomer (A).

Specific examples of the monomer (B-2) containing an aliphatic group having 8 or more carbon atoms include monomers shown by the following formula (IV):

(IV)

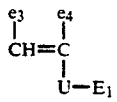

wherein $E_1$ represents an aliphatic group having 8 or more carbon atoms; U represents

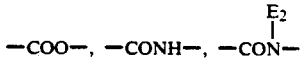

(wherein $E_2$ represents an aliphatic group), —OCO—, —$CH_2COO$—, or —O—; and $e_3$ and $e_4$, which may be the same or different, each represents a hydrogen atom, an alkyl group, —$COOE_3$, or —$CH_2COOE_3$ (wherein $E_3$ represents an aliphatic group).

In formula (IV), $E_1$ represents preferably an alkyl group having a total number of carbon atoms of 10 or more, which may be substituted, or an alkenyl group having a total number of carbon atoms of 10 or more and U represents preferably

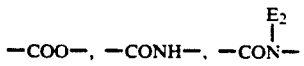

(wherein $E_2$ represents preferably an aliphatic group having from 1 to 32 carbon atoms (examples of the aliphatic group are an alkyl group, an alkenyl group, or an aralkyl group), —OCO—, —$CH_2OCO$— or —O—).

Also, $e_3$ and $e_4$, which may be the same or different, each represents preferably a hydrogen atom, a methyl group, —$COOE_3$, or —$CH_2COOE_3$ (wherein $E_3$ represents preferably an alkyl group having from 1 to 32 carbon atoms, an alkenyl group, an aralkyl group, or a cycloalkyl group).

In formula (IV), it is more preferable that U represents $$-COO-,\ -CONH-,\ \text{or}\ -\overset{\overset{E_2}{|}}{CON}-;$$

$e_3$ and $e_4$, which may be the same or different, each represents a hydrogen atom or a methyl group; and $E_1$ has the same meaning as described above.

Specific examples of the monomer (B-2) shown by formula (IV) are unsaturated carboxylic acid esters having an aliphatic group of from 10 to 32 total carbon atoms (examples of the carboxylic acid are acrylic acid, methacrylic acid, crotonic acid, maleic acid, and itaconic acid, and examples of the aliphatic group are decyl, dodecyl, tridecyl, tetradecyl, hexadecyl, octadecyl, docosanyl, dodecenyl, hexadecenyl, oleyl, linoleyl, and docosenyl; the above aliphatic group may have a substituent such as a halogen atom, a hydroxy group, an amino group, an alkoxy group, etc., or may have a hetero atom such as oxygen, sulfur, nitrogen, etc. in the carbon-carbon bond of the main chain thereof); unsaturated carboxylic acid amides having an aliphatic group having from 10 to 32 carbon atoms (the unsaturated carboxylic acid and the aliphatic group are same as those described above on the esters); vinyl esters or allyl esters of a higher aliphatic acid (examples of the higher aliphatic acid are lauric acid, myristic acid, stearic acid, oleic acid, linolic acid, and behenic acid); and vinyl ethers substituted with an aliphatic group having from 10 to 32 carbon atoms (the aliphatic group is the same as described above).

According to the above-described preferred embodiment of the present invention, the dispersion resin grains used in the present invention are composed of at least one kind of the monomer (A) and at least one kind of the monomer (B-2), and it is also important that the desired dispersion resin grains can be obtained if the resin synthesized from these monomers is insoluble in the non-aqueous solvent. More practically, the proportion of the monomer (B-2) shown by the general formula (IV) is preferably from 0.1 to 20% by weight, and more preferably from 0.3 to 8% by weight based on the amount of the monomer (A). The molecular weight of dispersion resin grains is preferably from $1\times10^3$ to $1\times10^6$, and more preferably from $1\times10^4$ to $1\times10^6$.

The dispersion-stabilizing resin used in the present invention is an AB block copolymer which is composed of a block comprising a polymer component of a repeating unit represented by the formula (I) (called as "A block") and a block comprising a polymer component containing at least one specific polar group as described above and/or a polymer component corresponding to the monofunctional monomer (A), and which has a weight average molecular weight of from $1\times10^4$ to $5\times10^5$.

The ratio of the A block and the B block in the AB block copolymer used in the present invention preferably ranges from 99/1 to 50/50 by weight.

The content of the polar group-containing component in the B block is preferably from 1 to 30 parts by weight, more preferably from 1 to 15 parts by weight, per 100 parts by weight of the dispersion-stabilizing resin. Also, when the polar group-containing polymer component is not present in the B block, the content of the polymer component corresponding to the above-described monofunctional monomer (A) is preferably from 5 to 50 parts by weight, more preferably 10 to 40 parts by weight, per 100 parts by weight of the dispersion-stabilizing resin.

The weight average molecular weight of the AB block copolymer is preferably from $2\times10^4$ to $1\times10^5$.

The repeating unit represented by the formula (I) which constitutes the A block is described hereinafter in detail.

In formula (I), Vs preferably represents —COO—, —OCO—, or —O—.

$R_0$ in formula (I) represents an alkyl or alkenyl group having 10 or more carbon atoms which may be straight chain or branched chain. Specific examples thereof include decyl, dodecyl, tridecyl tetradecyl, hexadecyl, octadecyl, eicosanyl, docosanyl, decenyl, dodecenyl, tridecenyl, hexadecenyl, octadecenyl, linoleyl groups.

$a_1$ and $a_2$, which may be the same or different, each preferably represents a hydrogen atom, a halogen atom (e.g., chlorine or bromine), a cyano group, an alkyl group having 1 to 3 carbon atoms (e.g., methyl, ethyl and propyl), —COO—$D_1$ or —$CH_2COO$—$D_1$ (wherein $D_1$ represents a hydrogen atom or a hydrocarbon group having not more than 22 carbon atoms which may be substituted (e.g., an alkyl group, an alkenyl group, an aralkyl group, an glicyclic group, and an aryl group).

Specific examples of $D_1$ include a hydrogen atom, and a hydrocarbon group having 1 to 22 carbon atoms which may be substituted, such as an alkyl group (e.g., methyl, ethyl, propyl, butyl, heptyl, hexyl, octyl, nonyl, decyl, dodecyl, tridecyl, tetradecyl, hexadecyl, octadecyl, eicosanyl, docosanyl, 2-chloroethyl, 2-bromoethyl, 2-cyanoethyl, 2-methoxycarbonylethyl, 2-methoxyethyl, and 3-bromopropyl), an alkenyl group having 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl, and linolenyl), an aralkyl group having 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

The A block of the dispersion-stabilizing resin used in the present invention may contain other repeating units as copolymer components in addition to the repeating unit represented by formula (I). Such copolymer components which may be present together with the repeating unit of the formula (I) may be any components of the monomer which is copolymerizable with the monomer corresponding to the repeating unit of the formula (I).

However, it is preferred that the A block does not contain the above-described components other than the repeating unit of the formula (I) and, if any, such other components are used at a proportion below 20 parts by weight per 100 parts by weight of the total polymerizable components in the A block. If the proportion of such other components exceeds 20 parts by weight, the dispersion stability of the resulting dispersed resin grains deteriorates.

The repeating unit represented by the formula (I) in the A block may be a combination of two or more of repeating units.

Then, the polymer components constituting the B block of the AB block copolymer used in the present invention is described hereinafter in detail.

The B block is composed of the polymer component corresponding to the monofunctional monomer (A) and/or the polymer component containing the above-described specific polar group.

The polymerizable components corresponding to the monofunctional monomer (A) include those described above for the monomer (A) to be insolubilized. In this case, the polymerizable components are preferably composed of the same monomer as the monofunctional monomer (A) which forms the resin grain dispersion.

In the polar group

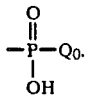

$Q_0$ represents $-Q_1$ or $-OQ$ wherein $Q_1$ represents a hydrocarbon group having 1 to 10 carbon atoms. $Q_1$ preferably represents an aliphatic group having 1 to 8 carbon atoms which may be substituted (e.g., methyl, ethyl, propyl, butyl, pentyl, hexyl, butenyl, pentenyl, hexenyl, 2-chloroethyl, 2-cyanoethyl, cyclopentyl, cyclohexyl, benzyl, phenethyl, chlorobenzyl, and bromobenzyl), or an aromatic group which may be substituted (e.g., phenyl, tolyl, xylyl, mesityl, chlorophenyl, bromophenyl, methoxyphenyl, and cyanophenyl).

Of the polar groups in the B block, the amino group represents

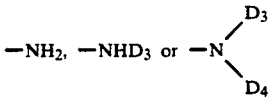

wherein $D_3$ and $D_4$, which may be the same or different, each represents a hydrocarbon group having 1 to 10 carbon atoms, preferably 1 to 7 carbon atoms, and specific examples thereof are those described above for the hydrocarbon groups represented by $Q_1$.

More preferably, the hydrocarbon groups of $Q_1$, $D_3$ and $D_4$ include an alkyl group having 1 to 4 carbon atoms which may be substituted, a benzyl group which may be substituted, and a phenyl group which may be substituted.

The monomer corresponding to the polymerizable component containing the above-described specific polar group can be any monofunctional monomer containing at least one of these polar groups. Examples of such monomers are described, e.g., in Kobunshi Gakkai (ed.), *Kobunshi Data Handbook* (*Kisohen*), Baifukan (1986). Specific examples of these monomers include acrylic acid, α- and/or β-substituted acrylic acids (e.g., α-acetoxy, α-acetoxymethyl, α-(2-amino)methyl, α-chloro, α-bromo, α-fluoro, α-tributylsilyl, α-cyano, β-chloro, β-bromo, α-chloro-β-methoxy, and α,β-dichloro compounds), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, dicarboxylic acid vinyl or allyl half esters, and ester or amide derivatives of these carboxylic acids or sulfonic acids containing the polar group in the substituent thereof.

Specific examples of these compounds are set forth below, but the present invention should not be construed as being limited thereto. In the following formulae, e represents —H, $-CH_3$, —Cl, —Br, —CN, $-CH_2COOCH_3$ or $-CH_2COOH$, f represents —H or $-CH_3$, $n_1$ represents an integer of 2 to 10, $m_1$ represents an integer of 1 to 10, $l_1$ represents an integer of 1 to 4, $X_1$ represents

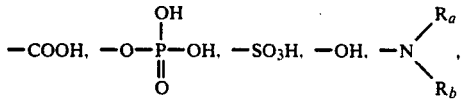

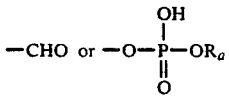

(wherein $R_a$ and $R_b$, each represents an alkyl group having 1 to 4 carbon atoms), and $X_2$ represents —COOH or —OH.

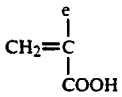

(1)

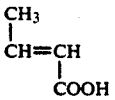

(2)

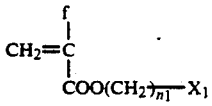

(3)

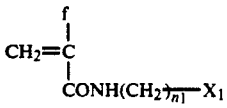

(4)

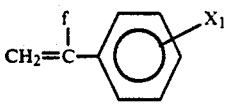

(5)

-continued (6)

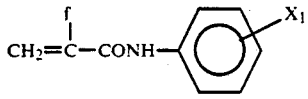

(7)

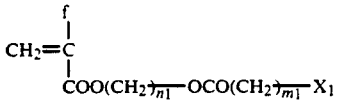

(8)

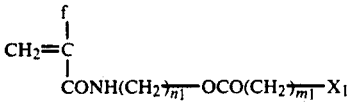

(9)

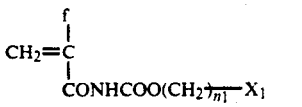

(10)

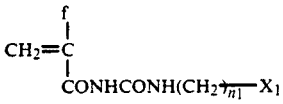

(11)

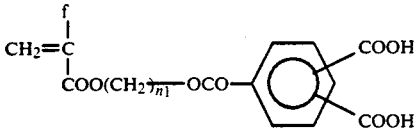

(12)

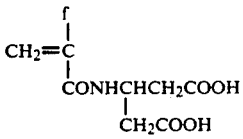

(13)

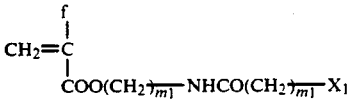

(wherein $m_1$'s may be the same or different)

(14)

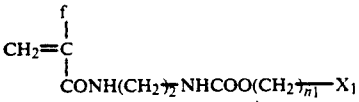

(15)

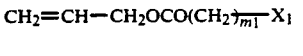

(16)

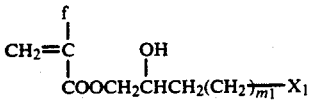

(17)

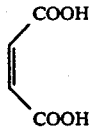

(18)

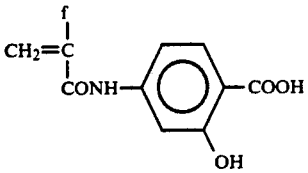

-continued (19)

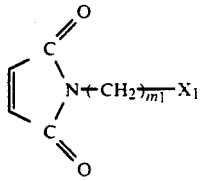

(20)

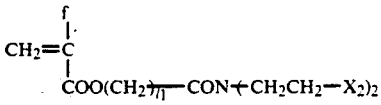

The AB type block copolymer used in the present invention can be produced by a conventionally known polymerization reaction method. More specifically, it can be produced by the method comprising previously protecting the polar group of a monomer corresponding to the polymer component having the specific polar group to form a functional group, synthesizing an AB type block copolymer by an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a so-called known living polymerization reaction such as a group transfer polymerization reaction, etc., and then conducting a protection-removing reaction of the functional group formed by protecting the polar group by a hydrolysis reaction, hydrogenolysis reaction, an oxidative decomposition reaction, or a photodecomposition reaction to form the polar group.

One of the examples is shown by the following reaction scheme (1):

Reaction Scheme (1)

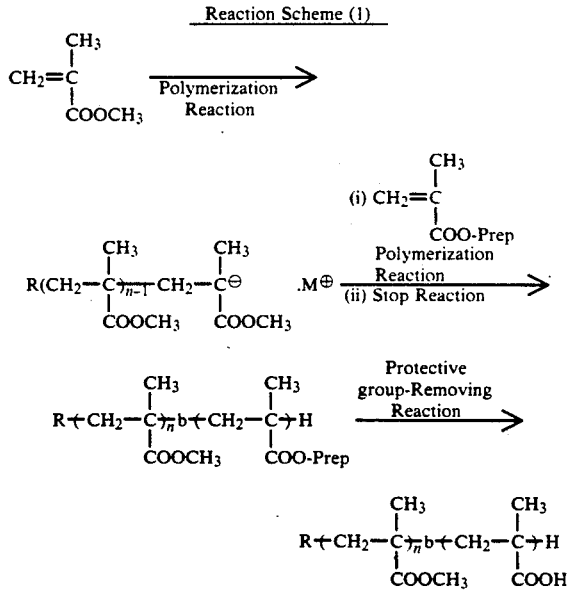

R: Alkyl group, porphyrin ring residue, etc.
Prep: Protective group (e.g., $-C(C_6H_5)_3$, $-Si(C_3H_7)_3$, etc.)
b: "-b-" represents that each of the repeating units bonded to -b- is present in the form of a block polymer component (hereinafter the same)

The above-described compounds can be easily synthesized according to the synthesis methods described, e.g., in P. Lutz, P. Masson et al, *Polym. Bull.*, 12, 79

(1984), B. C. Anderson, G. D. Andrews, et al, *Macromolecules*, 14, 1601 (1981), K. Hatada, K. Ute, et al, *Polym. J.*, 17, 977 (1985), ibid., 18, 1037 (1987), Toshinobu Higashimura and Mitsuo Sawamoto, *Kobunshi Ronbun Shu* (*Polymer Treatieses*, 46, 189 (1989), M. Kuroki and T. Aida, *J. Am. Chem. Soc.*, 109, 4737 (1989), Teizo Aida and Shohei Inoue, *Yuki Gosei Kagaku* (*Organic Synthesis Chemistry*), 43, 300 (1985), and D. Y. Sogah, W. R. Hertler et al, *Macromolecules*, 20, 1473 (1987).

Furthermore, the AB block copolymer can be also synthesized by a photoinitiator polymerization method using the monomer having the unprotected polar group and also using a dithiocarbamate compound as a photoinitiator. For example, the block copolymers can be synthesized according to the synthesis methods described in Takayuki Otsu, *Kobunshi* (*Polymer*), 37, 248 (1988), Shunichi Himori and Ryuichi Ohtsu, *Polym. Rep. Jap.* 37, 3508 (1988), JP-A-64-111, and JP-A-1-26619.

Also, the protection of the specific polar group of the present invention and the removal of the protective group (a reaction for removing a protective group) can be easily conducted by utilizing conventionally known knowledges, such as the methods described, e.g., in Yoshio Iwakura and Keisuke Kurita, *Hannosei Kobunshi* (*Reactive Polymer*), published by Kodansha (1977), T. W. Greene, *Protective Groups in Organic Synthesis*, published by John Wiley & Sons (1981), and J. F. W. McOmie, *Protective Groups in Organic Chemistry*, Plenum Press, (1973).

The dispersion resin grains (latex grains) used in the present invention can be generally produced by heat-polymerizing the above-described dispersion-stabilizing resin, the monomer (A) and, optionally, the monomer (B-1) or (B-2), in a non-aqueous solvent in the presence of a polymerization initiator such as benzoyl peroxide, azobis-isobutyronitrile, butyl-lithium, etc.

Practically, the dispersion resin grains can be produced by (1) a method of adding the polymerization initiator to a solution of a mixture of the dispersion-stabilizing resin, the monomer (A), and, optionally, the monomer (B-1) or (B-2), (2) a method of adding dropwise the monomer (A), and, optionally, the monomer (B-1) or (B-2), together with the polymerization initiator to a solution of the dispersion-stabilizing resin, (3) a method of adding the polymerization initiator and a part of a mixture of the monomer (A) and, optionally, the monomer (B-1) or (B-2) to a solution of the total amount of the dispersion-stabilizing resin and the remaining monomer (A) and, optionally, monomer (B-1) or (B-2), or (4) a method of adding a solution of the dispersion-stabilizing resin and the monomers (A) and, optionally, (B-1) or (B-2) together with the polymerization initiator to a non-aqueous solvent.

The total amount of the monomer (A) and, optionally, the monomer (B-1) or (B-2) is from about 5 to 80 parts by weight, and preferably from 10 to 50 parts by weight per 100 parts by weight of the non-aqueous solvent.

Also, the amount of the dispersion-stabilizing resin (dispersion stabilizer) which is a soluble resin is from 1 to 100 parts by weight, and preferably from 3 to 50 parts by weight per 100 parts by weight of the monomer (A) and more preferably from 5 to 20 parts by weight per 100 parts by weight of the total amounts of monomer (A) and, optionally, monomer (B-1) or (B-2).

A suitable amount of the polymerization initiator is from 0.1 to 5% by weight of the total amount of the monomers (A) and (B-1) or (B-2).

The polymerization temperature is from about 50° C. to 180° C., and preferably from 60° C. to 120° C. The reaction time is preferably from 1 to 15 hours.

When a polar solvent such as alcohols, ketones, ethers, esters, etc., is used together with the non-aqueous solvent for the above-described reaction or when unreacted monomer (A) and/or monomer (B-1) or (B-2) remain without being polymerization-granulated, it is preferred to remove the polar solvent or the unreacted monomers by heating the reaction mixture to the boiling point of the solvent or the monomers to distil them off or distil off the solvent or the monomers under reduced pressure.

The latex grains dispersed in a non-aqueous solvent thus produced exist as fine grains having a uniform grain size distribution and show a very stable dispersibility. In particular, when the liquid developer composed of the latex grains are repeatedly used in a developing device for a long period of time, the dispersibility thereof is good and when the development speed is increased, the re-dispersibility is easy and the occurrence of stains by adhesion of the grains onto each part of the developing device is not observed.

Also, when the latex grains are fixed by heating, etc., a strong coating or layer having an excellent fixing property can be formed.

Furthermore, the liquid developer according to the present invention shows excellent dispersion stability, re-dispersibility, and fixing property when the liquid developer is used in a quickened development-fix step with a prolonged interval period of the maintenance or when a large size master plate is developed. Also, the liquid developer according to the present invention provides a master plate for offset printing having an excellent printing durability.

In particular, JP-A-62-166362 and JP-A-63-66567 disclose the non-aqueous dispersed resin (latex grains) produced by polymerization-granulation of a monomer which is insolubilized by polymerization and a monomer containing at least two ester bonds, etc. in the molecule which is copolymerizable with the above monomer, in the presence of a dispersion-stabilizing resin composed of a random copolymer which is soluble in a non-aqueous solvent and which contains copolymerizable components having polymerizable double bonds at the site apart from the polymer main chain by the total number of more than 8 atoms. These resin grains provide markedly improved the dispersibility of resin grains and the printing durability as compared with conventional resin grains. However, they still have a problem in the re-dispersibility of resin grains when the liquid developer containing such resin grains is used in a plate-making machine for processing large size master plates for offset printing (e.g., ELP-560, ELP-820, etc. made by Fuji Photo Film Co., Ltd.) or when the liquid developer is used for plate-making at a high speed, thereby producing stains of plate-making machine (in particular, stains of developing device), causing aggregation and sedimentation of grains, or reducing the printing durability due to insufficient strength in the image areas. On the other hand, the liquid developer containing the dispersed resin according to the present invention has substantially no problems under the above-described severe conditions.

As described above, the high dispersibility of the latex grains of the present invention is fully depend on the soluble AB block copolymer used in combination with the monomer (A) to be insolubilized and, optionally, the monomer (B-1) or (B-2).

That is, the characteristic feature of the present invention resides in that the dispersion-stabilizing resin is an AB block copolymer composed of an A block comprising polymerizable components containing a long chain aliphatic group having a high affinity for the non-aqueous solvent used, and a B block comprising polymerizable components having a low affinity for the non-aqueous solvent and a high affinity for the monomer (A) to be insolubilized.

Due to the above properties of the AB block copolymer used in the present invention, it is considered that the B block portion is well adsorbed onto the dispersed resin by physical and chemical interaction during the polymerization-granulation, and the A block having a high affinity for the non-aqueous dispersion solvent is well solvated with the solvent and well produces steric repulsive effects (i.e., adsorbed in the tail form) thereby achieving the effect of the present invention.

On the other hand, in the conventional random copolymer composed of the polymer components used as the A block and the polymer components used as the B block, since the component as an adsorbing portion is randomly bonded in a high molecular weight chain composed of the components to be solvated, absorption onto the dispersed resin grains is not sufficient and moreover the adsorption occurs in a loop form, the steric repulsive effect is decreased whereby stable dispersion cannot be obtained.

Further, it is considered that the high printing durability of the offset master plate resulting from less deterioration of the toner image during printing can be achieved by the formation of a uniform and stiff film, since the monomer (A) to be insolubilized and, optionally, the monomer (B-1) or (B-1), and the dispersed polymer adsorbed thereon have a good mutual solubility and are sufficiently solubilized under mild fixing condition to form a uniform and stiff film.

The liquid developer of the present invention may contain, if desired, a colorant.

There is no specific restriction on the colorant being used, and any conventional pigments or dyes can be used as the colorant in the present invention.

In the case of coloring the dispersion resin itself, there is, for example, a method of coloring the dispersion resin by physically dispersing a pigment or dye in the dispersion resin and various pigments and dyes can be used. For example, there are a magnetic iron oxide powder, a lead iodide powder, carbon black, nigrosine, Alkali Blue, Hansa Yellow, quinacridone red, phthalocyanine blue, etc.

As another method of coloring the dispersion resin grains, the dispersion resin may be dyed with a desired dye, for example, as disclosed in JP-A-57-48738. As still other method, a dye may be chemically bonded to the dispersion resin as disclosed, for example, in JP-A-53-54029 or a previously dye-containing monomer is used in the polymerization granulation to provide a dye-containing dispersion resin as disclosed, for example, in JP-B-44-22955. (The term "JP-B" as used herein means an "examined Japanese patent publication".).

Various additives may be added to the liquid developer for enhancing the charging characteristics or improving the image characteristics and they are practically described in Yuji Harasaki, *Electrophotography*, Vol. 16, No. 2, page 44.

Specific examples of these additives include metal salts of 2-ethylhexylsulfosuccinic acid, metal salts of naphthenic acid, metal salts of higher fatty acids, lecitin, poly(vinylpyrrolidone), and copolymers containing a semi-maleic acid amide component.

The amounts of the main constituting components of the liquid developer of the present invention are further described below.

The amount of the toner grains consisting essentially of the dispersion resin and, if desired, a colorant is preferably from about 0.5 to 50 parts by weight per 1,000 parts by weight of the liquid carrier. If the amount thereof is less than about 0.5 part by weight, the image density formed is sufficient and, if the amount exceeds about 50 parts by weight, non-image portions are liable to be fogged. Further, the above-described liquid carrier-soluble resin for enhancing the dispersion stability may also be used, if desired, in an amount of from about 0.5 by weight to about 100 parts by weight per 1,000 parts by weight of the liquid carrier. Also, the charge-controlling agent as described above can be used preferably in an amount of from 0.001 part by weight to 1.0 part by weight per 1,000 parts by weight of the liquid carrier.

Furthermore, if desired, various additives may be added to the liquid developer and the total amount of these additives is restricted by the electric resistance of the liquid developer. That is, if the electric resistance of the liquid developer in a state of excluding the toner grains therefrom becomes lower than $10^9$ Ωcm, continuous tone images having good image quality are reluctant to obtain and, hence, it is necessary to control the amounts of additives in the aforesaid range of not lowering the electric resistance than $10^9$ Ωcm.

Then, the following examples are intended to illustrate the embodiments of this invention in detail but not to limit the scope of the present invention in any way.

Production Example 1 of Dispersion-Stabilizing Resin: P-1

A mixed solution of 95 g of dodecyl methacrylate, and 200 g of tetrahydrofuran was sufficiently degassed in a nitrogen stream and cooled to −78° C. Then, 1.0 g of 1,1-diphenylbutyl lithium was added to the mixture, and the reaction was conducted for 12 hours. Separately, a mixed solution of 5 g of triphenylmethyl methacrylate and 25 g of tetrahydrofuran was sufficiently degassed in a nitrogen stream, and the resulting mixed solution was added to the above described mixture, and then reaction was further conducted for 8 hours. After adjusting the temperature of the reaction mixture to 0° C., 10 ml of methanol was added to the mixture, followed by reacting for 30 minutes to terminate the polymerization reaction.

The temperature of the reaction solution obtained was raised to 30° C. under stirring, 15 ml of a 30 wt % ethanol solution of hydrogen chloride was added thereto, and the mixture was stirred for one hour. Then, the solvent of the reaction mixture was distilled off under reduced pressure until the whole volume was reduced to a half, and the mixture was reprecipitated from one liter of methanol.

The precipitates thus formed were collected and dried under reduced pressure to obtain 70 g of a polymer (P-1) shown below having a weight average molecular weight (Mw) of $4.5\times10^4$.

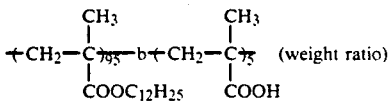

(P-1)

(weight ratio)

(wherein —b— is as defined above)

Production Example 2 of Dispersion-Stabilizing Resin: P-2

A mixed solution of 46 g of octadecyl methacrylate, 0.5 g of (tetraphenyl porphinate) aluminum methyl, and 60 g of methylene chloride was raised to a temperature of 30° C. in a nitrogen stream. The mixture was irradiated with light from a xenon lamp of 300 W at a distance of 25 cm through a glass filter, and the reaction was conducted for 12 hours. To the mixture was further added 4 g of benzyl methacrylate, after similarly light-irradiating for 8 hours, 3 g of methanol was added to the reaction mixture followed by stirring for 30 minutes, then the reaction was terminated. Then, Pd-C was added to the reaction mixture, and a catalytic reduction reaction was conducted for one hour at 25° C.

After removing insoluble substances from the reaction mixture by filtration, the reaction mixture was reprecipitated from 500 ml of methanol, and the precipitate thus formed was collected and dried to obtain 33 g of a polymer (P-2) shown below having an Mw of $3\times10^3$.

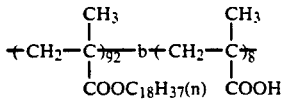

(P-2)

Production Example 3 of Dispersion-Stabilizing Resin: P-3

A mixed solution of 90 g of tridecyl methacrylate and 200 g of tetrahydrofuran was sufficiently degassed in a nitrogen stream and cooled to −78° C. Then, 0.8 g of 1,1-diphenyl-3-methylpentyl lithium was added to the mixture followed by stirring for 6 hours. Separately, a mixed solution of 10 g of 4-vinylphenyloxytrimethylsilane was added to the above described mixture, and then reaction mixture was stirred for 8 hours. Thereafter, 3 g of methanol was added thereto, followed by stirring for 30 minutes.

Then, to the reaction mixture was added 10 ml of a 30 wt % ethanol solution of hydrogen chloride and, after stirring the mixture for one hour at 25° C., the mixture was reprecipitated from one liter of methanol. The precipitates thus formed were collected, washed twice with 300 ml of methanol and dried to obtain 58 g of a polymer (P-3) shown below having an Mw of $3.5\times10^4$.

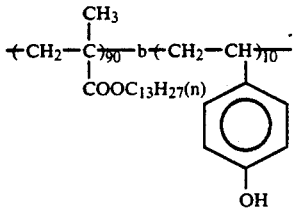

(P-3)

Production Example 4 of Dispersion-Stabilizing Resin: P-4

A mixture of 95 g of hexadecyl methacrylate and 2.0 g of benzyl N,N-diethyldithiocarbamate was placed in a vessel in a nitrogen stream followed by closing the vessel and heated to 60° C. The mixture was irradiated with light from a high-pressure mercury lamp for 400 W at a distance of 10 cm through a glass filter for 10 hours to conduct a photopolymerization. Then, 5 g of acrylic acid and 180 g of methyl ethyl ketone were added to the mixture and, after replacing the gas in the vessel with nitrogen, the mixture was light-irradiated again for 10 hours.

The reaction mixture was reprecipitated from 1.5 liters of methanol and the precipitates thus formed were collected and dried to obtain 68 g of a polymer (P-4) shown below having an Mw of $4\times10^4$.

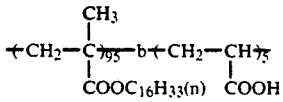

(P-4)

Production Example 5 of Dispersion-Stabilizing Resin: P-5

A mixed solution of 80 g of stearyl methacrylate and 200 g of tetrahydrofuran was sufficiently degassed in a nitrogen stream and cooled to −78° C. Then, 1.0 g of 1,1-diphenyl-3-methylpentyl potassium was added to the mixture, followed by stirring for 10 hours. Further, 20 g of styrene was added to the mixture, and the resulting mixture was stirred for 8 hours. The reaction mixture was adjusted to a temperature of 0° C., and 10 ml of methanol was added thereto. The mixture was reprecipitated from 1.5 liter of methanol, and the precipitate thus formed was collected by filtration and dried to obtain 68 g of a polymer (P-5) shown below having an Mw of $3\times10^4$.

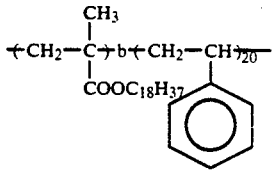

(P-5)

Production Example 1 of Latex Grains: D-1

A mixed solution of 10 g of the dispersion-stabilizing resin P-1, 100 g of vinyl acetate, and 380 g of Isopar H was heated to 70° C. with stirring under nitrogen gas stream. Then, after adding thereto 0.8 g of 2,2'-azobis-(isovaleronitrile) (A.I.V.N.) as a polymerization initiator, the reaction was carried out for 2 hours.

20 minutes after the addition of the polymerization initiator, the reaction mixture became white-turbid and the reaction temperature raised to 88° C. Then, the temperature of the reaction mixture was raised to 100° C. and stirred for 2 hours to distil off unreacted vinyl acetate. After cooling, the reaction mixture was passed through a 200 mesh nylon cloth so as to remove coarse grains to obtain the desired latex having a mean grain size of 0.21 μm with a polymerization ratio of 86% as a white dispersion.

Production Examples 2 to 4 of Latex Grains: D-2 to D-4

By following the same procedure as Production Example 1 of latex grains except that each of the dispersion-stabilizing resins described in Table 1 below was used in place of the dispersion-stabilizing resin P-1, each of the latex grains D-2 to D-4 was produced.

TABLE 1

| Production Example of Latex Grains | Latex Grains | Dispersion-Stabilizing Resin and Amount | | Latex Grain Polymerization Ratio (%) | Latex Grain Mean Grain Size (μm) |
|---|---|---|---|---|---|
| 2 | D-2 | P-2 | 12 g | 83 | 0.23 |
| 3 | D-3 | P-3 | 11 g | 85 | 0.25 |
| 4 | D-4 | P-5 | 13 g | 86 | 0.22 |

Production Examples 5 to 9 of Latex Grains: D-5 to D-9

By following the same procedure as Production Example 1 of latex grains except that each of the dispersion-stabilizing resins described in Table 2 below was used in place of the dispersion-stabilizing resin P-1, each of the latex grains D-5 to D-9 was produced. The polymerization ratios of the latex grains obtained were from 83 to 88%.

TABLE 2

| Production Example of Latex Grains | Latex Grains | Kind and Amount of Dispersion-Stabilizing Resin (Weight Composition Ratio) | | Mean Grain Size of Latex |
|---|---|---|---|---|
| 5 | D-5 | P-6 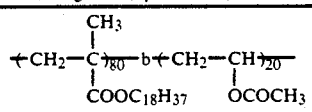 | 14 g | 0.20 μm |
| 6 | D-6 | P-7 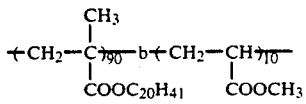 | 15 g | 0.23 μm |
| 7 | D-7 | P-8 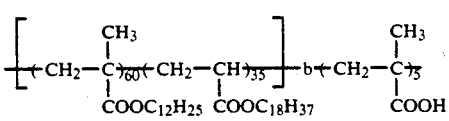 | 12 g | 0.22 μm |
| 8 | D-8 | P-9 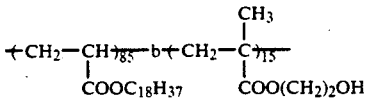 | 14 g | 0.21 μm |
| 9 | D-9 | P-10 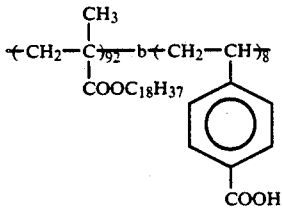 | 13 g | 0.22 μm |

Production Example 10 of Latex Grains: D-10

A mixed solution of 85 g of vinyl acetate, 15 g of N-vinylpyrolidone, 12 g of the dispersion-stabilizing resin P-1, and 380 g of n-decane was heated to 75° C with stirring under nitrogen gas stream. Then, after adding 1.7 g of 2,2'-azobisisobutyronitrile (abbreviated as A.I.B.N.) to the reaction mixture, the reaction was carried out for 4 hours and, after further adding thereto 0.5 g of A.I.B.N., the reaction was carried out for 2 hours. After cooling, the reaction mixture obtained was passed through a 200 mesh nylon cloth to obtain the desired latex grains having a mean grain size of 0.25 μm as a white dispersion.

Production Example 11 of Latex Grains: D-11

A mixed solution of 20 g of the dispersion-stabilizing resin P-7 and 470 g of n-dodecane was heated to 60° C. with stirring under nitrogen gas stream. Then, a mixed solution of 100 g of methyl methacrylate, 1.0 g of n-dodecylmercaptan and 0.8 g of A.B.V.N. was added dropwise to the reaction mixture over a period of 2 hours, and the resulting mixture was reacted for 2 hours as it was. 0.3 g of A.B.V.N. was further added thereto, the mixture was reacted for 2 hours. After cooling, the reaction mixture obtained was passed through a 200 mesh nylon cloth to obtain the desired latex grains having a mean grain size of 0.28 μm as a white dispersion.

Production Example 12 of Latex Grains: D-12

A mixed solution of 14 g of the dispersion-stabilizing resin P-11 having the formula shown below, 100 g of vinyl acetate, 5 g of crotonic acid and 468 g of Isopar E was heated to 70° C. with stirring under nitrogen gas stream and, after adding 0.8 g of A.B.V.N. to the reaction mixture, the reaction was carried out for 6 hours. The temperature was elevated to 100° C., and the mixture was stirred at that temperature for 1 hour to remove remaining vinyl acetate. After cooling, the reaction mixture was passed through 200 mesh nylon cloth in order to remove coarse grains to obtain latex grains having a mean grain size of 0.24 μm with a polymerization ratio of 88% as a white dispersion.

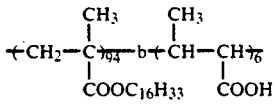

(P-11)

Weight average molecular weight: $3.3\times10^4$

Production Example 13 of Latex Grains: D-13

A mixed solution of 14 g of the dispersion-stabilizing resin P-12 having the formula shown below, 100 g of vinyl acetate, 6.0 g of 4-pentenoic acid, and 380 g of Isopar G was heated to 75° C. with stirring under nitrogen gas stream. Then, after adding 0.7 g of A.B.V.N. to the reaction mixture, the reaction was carried out for 4 hours and, after further adding thereto 0.5 g of A.B.V.N., the reaction was carried out for 2 hours. After cooling, the reaction mixture was passed through a 200 mesh nylon cloth so as to remove coarse grains to obtain latex grains having a mean grain size of 0.23 μm as a white dispersion.

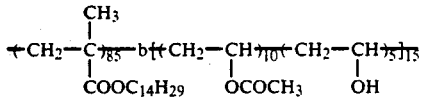

(P-12)

Weight average molecular weight: $3.0\times10^4$

Production Example 14 of Latex Grains: D-14

A mixed solution of 100 g of styrene, 16 g of the dispersion-stabilizing resin P-5, and 380 g of Isopar H was heated to 60° C. with stirring under nitrogen gas stream and, after adding 0.6 g of A.B.V.N. to the reaction mixture, the reaction was carried out for 4 hours. Then, after further adding thereto 0.3 g of A.B.V.N., the reaction was carried out for 3 hours. After cooling, the reaction mixture was passed through a 200 mesh nylon cloth so as to remove coarse grains to obtain the desired latex grains having a mean grain size of 0.18 μm as a white dispersion.

Production Example 15 of Latex Grains: Comparison Example A

By following the same procedure as Production Example 1 of latex grains D-1 except that a mixed solution of 20 g of poly(octadecyl methacrylate), 100 g of vinyl acetate, 1.0 g of octadecyl methacrylate and 385 g of Isopar H was used in place of the mixture used in Example 1, latex grains having a mean grain size of 0.20 μm were obtained with a polymerization ratio of 85% as a white dispersion. (Latex grains disclosed in JP-A-60-179751).

Production Example 16 of Latex Grains: Comparison Example B

By following the same procedure as Production Example 1 of latex grains D-1 except that a mixed solution of 10 g of a dispersion-stabilizing resin R-1 having the formula shown below, 100 g of vinyl acetate, 1 g of Monomer (I) having the formula shown below, and 385 g of Isopar H was used in place of the mixture used in Example 1, latex grains having a mean grain size of 0.24 μm were obtained with the polymerization ratio of 86% as a white dispersion. (Latex grains disclosed in JP-A-63-66567).

Monomer (I)

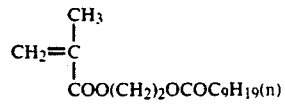

Dispersion-Stabilizing Resin: R-1

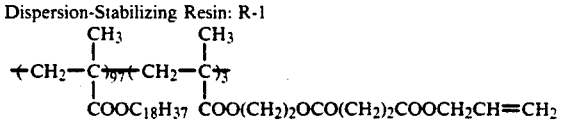

(Weight Composition Ratio)

Production Example 17 of Latex Grains: D-17

A mixed solution of 14 g of the dispersion-stabilizing resin P-1, 100 g of vinyl acetate, 1.5 g of Compound III-19 of Monomer (B-1) and 384 g of Isopar H was heated to 70° C. with stirring under nitrogen gas stream. Then, after adding thereto 0.8 g of 2,2'-azobis-(isovaleronitrile) (A.I.V.N.) as a polymerization initiator, the reaction was carried out for 6 hours.

20 minutes after the addition of the polymerization initiator, the reaction mixture became white-turbid and the reaction temperature raised to 88° C. Then, the temperature of the reaction mixture was raised to 100° C. and stirred for 2 hours to distil off unreacted vinyl acetate. After cooling, the reaction mixture was passed through a 200 mesh nylon cloth so as to remove coarse grains to obtain the desired latex having a mean grain size of 0.24 μm with a polymerization ratio of 86% as a white dispersion.

Production Examples 18 to 20 of Latex Grains: D-18 to D-20

By following the same procedure as Production Example 17 of latex grains except that each of the dispersion-stabilizing resins described in Table 3 below was used in place of the dispersion-stabilizing resin P-1, each of the latex grains D-18 to D-20 was produced.

TABLE 3

| Production Example of Latex Grains | Latex Grains | Dispersion-Stabilizing Resin and Amount | | Latex Grain Polymerization Ratio (%) | Latex Grain Mean Grain Size (μm) |
|---|---|---|---|---|---|
| 18 | D-18 | P-2 | 14 g | 89 | 0.23 |
| 19 | D-19 | P-3 | 14 g | 88 | 0.25 |
| 20 | D-20 | P-5 | 15 g | 89 | 0.24 |

Production Examples 21 to 25 of Latex Grains: D-21 to D-25

By following the same procedure as Production Example 17 of latex grains except that each of the dispersion-stabilizing resins described in Table 4 below was used in place of the dispersion-stabilizing resin P-1, each of the latex grains D-21 to D-25 was produced. The polymerization ratios of the latex grains obtained were from 85 to 90%.

TABLE 4

| Production Example of Latex Grains | Latex Grains | Kind and Amount of Dispersion Stabilizing Resin (Weight Composition Ratio) | | Mean Grain Size of Latex |
|---|---|---|---|---|
| 21 | D-21 | P-6 | 14 g | 0.20 μm |

TABLE 4-continued

| Production Example of Latex Grains | Latex Grains | Kind and Amount of Dispersion Stabilizing Resin (Weight Composition Ratio) | | Mean Grain Size of Latex |
|---|---|---|---|---|
| 22 | D-22 | P-7 | 15 g | 0.23 μm |
| 23 | D-23 | P-8 | 12 g | 0.22 μm |
| 24 | D-24 | P-9 | 14 g | 0.21 μm |
| 25 | D-25 | P-10 | 13 g | 0.22 μm |

Production Examples 26 to 46 of Latex Grains: D-26 to D-46

By following the same procedure as Production Example 17 of latex grains except that dispersion-stabilizing resin and the monomer (B-1) shown in Table 5 below were used in place of the dispersion-stabilizing resin P-1 and Compound III-19 as monomer (B-1), respectively, each of the latex grains D 26 to D-46 was produced. The polymerization ratios of the latex grains obtained were from 85 to 90%. Also, the mean grain size of the resulting latex grains was in the range of from 0.18 to 0.25 μm, and the latex had excellent mono-dispersibility.

TABLE 5

| Production Example of Latex Grains | Latex Grains | Dispersion-Stabilizing Resin | Monomer (II-1) |
|---|---|---|---|
| 26 | D-26 | P-1 | III-1 |
| 27 | D-27 | " | III-2 |
| 28 | D-28 | " | III-3 |
| 29 | D-29 | " | III-8 |
| 30 | D-30 | " | III-9 |
| 31 | D-31 | " | III-10 |
| 32 | D-32 | " | III-11 |
| 33 | D-33 | " | III-14 |
| 34 | D-34 | " | III-18 |
| 35 | D-35 | P-2 | III-10 |
| 36 | D-36 | P-3 | III-19 |
| 37 | D-37 | P-5 | III-20 |
| 38 | D-38 | P-5 | III-21 |
| 39 | D-39 | P-7 | III-22 |
| 40 | D-40 | P-7 | III-23 |
| 41 | D-41 | P-7 | III-24 |
| 42 | D-42 | P-8 | III-15 |
| 43 | D-43 | P-8 | III-16 |
| 44 | D-44 | P-8 | III-26 |
| 45 | D-45 | P-2 | III-27 |
| 46 | D-46 | P-3 | III-29 |

Production Example 47 of Latex Grains: D-47

A mixed solution of 10 g (as solid component) of the dispersion-stabilizing resin P-1, 6 g of poly(dodecyl methacrylate), 100 g of vinyl acetate, 1.5 g of Compound III-15 as monomer (B-1), and 380 g of n-decane was heated to 75° C. with stirring under nitrogen gas stream. Then, after adding 1.0 g of 2,2'-azobis-(isobutyronitrile) (abbreviated as A.I.B.N.) to the reaction mixture, the reaction was carried out for 4 hours and, after further adding thereto 0.5 g of A.I.B.N., the reaction was carried out for 2 hours. The temperature of the reaction mixture was elevated to 110° C., and the reaction mixture was stirred for 2 hours to distil off the low-boiling solvent and remaining vinyl acetate. After cooling, the reaction mixture was passed through a 200 mesh nylon cloth to obtain the desired latex grains having a mean grain size of 0.18 μm as a white dispersion.

Production Example 48 of Latex Grains: D-48

A mixed solution of 13 g of the dispersion-stabilizing resin P-13 having the formula shown below, 90 g of vinyl acetate, 2.0 g of Compound III-23 as monomer (B-1), 15 g of N-vinylpyrrolidone, and 400 g of isododecane was heated to 65° C. with stirring under nitrogen gas stream and, after adding 1.5 g of A.I.B.N. to the reaction mixture, the reaction was carried out for 4 hours. After cooling, the reaction mixture was passed through a 200 mesh nylon cloth to obtain the desired latex grains having a mean grain size of 0.26 μm as a white dispersion.

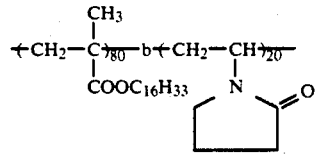

(P-13)

Weight average molecular weight: $7\times10^4$

Production Example 49 of Latex Grains: D-49

A mixed solution of 16 g of the dispersion-stabilizing resin P-4, 94 g of vinyl acetate, 6 g of 4-pentenoic acid, 1.5 g of Compound III-19 as monomer (B-1), and 383 g of Isopar G was heated to 60° C. with stirring under nitrogen gas stream. Then, after adding 1.0 g of 2,2'-azobis(isovaleronitrile) (A.I.V.N.) to the reaction mixture, the reaction was carried out for 2 hours and, after further adding thereto 0.5 g of A.I.V.N., the reaction was carried out for 2 hours. After cooling, the reaction mixture was passed through a 200 mesh nylon cloth to obtain the desired latex grains having a mean grain size of 0.24 μm as a white dispersion.

Production Example 50 of Latex Grains: D-50

A mixed solution of 20 g of the dispersion-stabilizing resin P-14 having the formula shown below, 2 g of Compound III 17 as monomer (B-1), 1.2 g of n-dodecylmercaptan, 100 g of methyl methacrylate, and 688 g of Isopar H was heated to 65° C. with stirring under nitrogen gas stream and, after adding 1.2 g of A.I.V.N. to the reaction mixture, the reaction was carried out for 4 hours. After cooling, the reaction mixture was passed through a 200 mesh nylon cloth so as to remove coarse grains to obtain the desired latex grains having a mean grain size of 0.28 μm as a white dispersion.

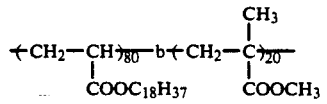

(P-14)

Weight average molecular weight: $6\times10^4$

Production Example 51 of Latex Grains: D-51

A mixed solution of 18 g of the dispersion-stabilizing resin P-15 having the formula shown below, 100 g of vinyl acetate, 5 g of crotonic acid, 2 g of Compound III-29 as monomer (B-1) and 468 g of Isopar E was heated to 70° C. with stirring under nitrogen gas stream and, after adding 0.8 g of A.I.V.N. to the reaction mixture, the reaction was carried out for 6 hours. The temperature was elevated to 100° C., and the mixture was stirred for one hour to distil off the remaining vinyl acetate. After cooling, the reaction mixture was passed through a 200 mesh nylon cloth so as to remove coarse grains to obtain the desired latex grains having a mean grain size of 0.26 μm with a polymerization ratio of 85% as a white dispersion.

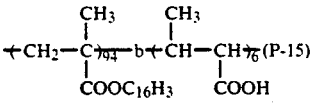

(P-15)

Weight average molecular weight: $3.3\times10^4$

Production Example 52 of Latex Grains: D-52

A mixed solution of 20 g of the dispersion-stabilizing resin P-5, 100 g of styrene, 4 g of Compound III-25 as monomer (B-1), and 380 g of Isopar H was heated to 50° C. with stirring under nitrogen gas stream and, after adding 1.0 g (as solid component) of a hexane solution of n-butyl lithium to the reaction mixture, the reaction was carried out for 4 hours. After cooling, the reaction mixture was passed through a 200 mesh nylon cloth to obtain desired latex grains having a mean grain size of 0.27 μm as a white dispersion.

Production Example 53 of Latex Grains: D-53

A mixed solution of 20 g of the dispersion-stabilizing resin P-16 having the following formula and 680 g of n-dodecane was heated to 60° C. with stirring under nitrogen gas stream. Then, a mixed solution of 100 g of methyl methacrylate, 1.0 g of n-dodecylmercaptan, 3 g of Compound III-1 as monomer (B-1) and 0.8 g of A.I.V.N. was added dropwise to the above solution over 2 hours. After reacting the mixture for 2 hours, 0.3 g of A.I.V.N. was further added thereto, followed by reacting the mixture for 2 hours. After cooling, the reaction mixture was passed through a 200 mesh nylon cloth so as to remove coarse grains to obtain the desired latex grains having a mean grain size of 0.25 μm as a white dispersion.

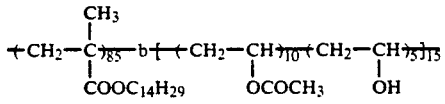

(P-16)

Weight average molecular Weight: $3.0\times10^4$

Production Example 54 of Latex Grains: Comparison Example C

By following the same procedure as Production Example 17 of latex grains D-15 except that a mixed solution of 20 g of poly(octadecyl methacrylate), 100 g of vinyl acetate, 1.2 g of Monomer (I) having the formula shown below and 385 g of Isopar H was used in place of the mixture used in Example 17, latex grains having a mean grain size of 0.23 μm were obtained with a polymerization ratio of 85% as a white dispersion. (Latex grains disclosed in JP-A-62-166362).

Production Example 55 of Latex Grains: Comparison Example D

By following the same procedure as Production Example 17 of latex grains D-15 except that a mixed solution of 10 g of a dispersion-stabilizing resin R-1 having the formula shown below, 100 g of vinyl acetate, 1 g of Monomer (I) having the formula shown below, and 385 g of Isopar H was used in place of the mixture used in Example 1, latex grains having a mean grain size of 0.24 μm were obtained with the polymerization ratio of 86% as a white dispersion. (Latex grains disclosed in JP-A-63-66567).

Monomer (I)

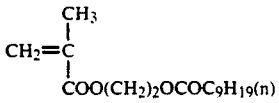

Dispersion-Stabilizing Resin: R-1

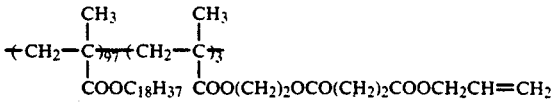

(Weight Composition Ratio)

Production Example 56 of Latex Grains: D-56

A mixed solution of 15 g of the dispersion-stabilizing resin P-1, 100 g of vinyl acetate, 1.0 g of octadecyl methacrylate, and 384 g of Isopar H was heated to 70° C. with stirring under nitrogen gas stream and, after adding 0.8 g of A.I.V.N. to the reaction mixture, the reaction was carried out for 6 hours. Twenty minutes after the addition of the polymerization initiator, the reaction mixture became white-turbid, and the reaction temperature raised to 88° C. Then, after raising the temperature to 100° C., the reaction mixture was stirred for 2 hours to distil off unreacted vinyl acetate. After cooling, the reaction mixture was passed through a 200 mesh nylon cloth to obtain the desired latex grains having a mean grain size of 0.24 μm with a polymerization ratio of 90% as a white dispersion.

Production Example 57 to 59 of Latex Grains: D-57 to D-59

By following the same procedure as Production Example 56 except that each of the dispersion-stabilizing resins described in Table 6 below was used in place of the dispersion-stabilizing resin P-1, each of the Latex Grains D-57 to D-59 was obtained.

TABLE 6

| Production Example of Latex Grains | Latex Grains | Dispersion-Stabilizing Resin and Amount | | Latex Polymerization Ratio (%) | Latex Mean Grain Size (μm) |
|---|---|---|---|---|---|
| 57 | D-57 | P-2 | 14 g | 83 | 0.23 |
| 58 | D-58 | P-3 | 14 g | 85 | 0.25 |
| 59 | D-59 | P-4 | 15 g | 86 | 0.22 |

Production Examples 60 to 64 of Latex Grains: D-60 to D-64

By following the same procedure as Production Example 52 of latex grains except that each of the dispersion-stabilizing resins described in Table 7 below was used in place of the dispersion-stabilizing resin P-1, each of the latex grains D-60 to D-64 was produced. The polymerization ratios of the latex grains obtained were from 83 to 88%.

TABLE 7

| Production Example of Latex Grains | Latex Grains | Kind and Amount of Dispersion Stabilizing Resin (Weight Composition Ratio) | | Mean Grain Size of Latex |
|---|---|---|---|---|
| 60 | D-60 | P-6 | 14 g | 0.20 μm |
| 61 | D-61 | P-7 | 16 g | 0.23 μm |
| 62 | D-62 | P-8 | 12 g | 0.22 μm |
| 63 | D-63 | P-9 | 14 g | 0.21 μm |
| 64 | D-64 | P-10 | 13 g | 0.22 μm |

Production Example 65 to 70 of Latex Grains: D-65 to D-70

By following the same procedure as Production Example 56 of latex grains except that 0.8 g of each of the monomers shown in Table 8 was used in place of 1 g of octadecyl methacrylate in the example, each of latex grains was produced.

TABLE 8

| Production Example of Latex Grains | Latex Grains | Monomer | Latex Grains Polymerization Ratio (%) | Latex Grains Mean Grain Size (μm) |
|---|---|---|---|---|
| 65 | D-65 | Docosanyl Methacrylate | 87 | 0.23 |
| 66 | D-66 | Hexadecyl Methacrylate | 87 | 0.24 |
| 67 | D-67 | Tetradecyl Methacrylate | 88 | 0.24 |
| 68 | D-68 | Tridecyl Methacrylate | 86 | 0.24 |
| 69 | D-69 | Dodecyl Methacrylate | 86 | 0.23 |
| 70 | D-70 | Decyl Methacrylate | 87 | 0.26 |

Production Example 71 of Latex Grains: D-71

A mixed solution of 10 g of the dispersion-stabilizing resin P-10, 4 g of poly(octadecyl methacrylate), 100 g of vinyl acetate, 0.8 g of dodecyl methacrylate, and 400 g of Isopar H was heated to 75° C. with stirring under nitrogen gas stream. Then, after adding 0.7 g of 2,2'-azobis(isobutyronitrile) (abbreviated as A.I.B.N.) to the reaction mixture, the reaction was carried out for 4 hours and, after further adding thereto 0.5 g of A.I.B.N., the reaction was carried out for 2 hours. After cooling, the reaction mixture was passed through a 200 mesh nylon cloth to obtain the desired latex grains having a mean grain size of 0.20 μm as a white dispersion.

Production Example 72 of Latex Grains: D-72

A mixed solution of 14 g of the dispersion-stabilizing resin P-13 having the formula shown below, 90 g of vinyl acetate, 10 g of N-vinylpyrrolidone, 1.5 g of octadecyl methacrylate, and 400 g of isododecane was heated to 65° C. with stirring under nitrogen gas stream and, after adding 1.5 g of A.I.B.N. to the reaction mixture, the reaction was carried out for 4 hours. After cooling, the reaction mixture was passed through a 200 mesh nylon cloth to obtain the desired latex grains having a mean grain size of 0.25 μm as a white dispersion.

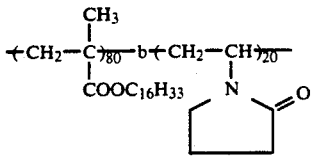

(P-13)

Weight average molecular weight: $7\times10^4$

Production Example 73 of Latex Grains: D-73

A mixed solution of 14 g of the dispersion-stabilizing resin P-4, 94 g of vinyl acetate, 6 g of crotonic acid, 2 g of hexadecyl methacrylate, and 378 g of Isopar G was heated to 60° C. with stirring under nitrogen gas stream. After adding 1.0 g of A.I.V.N. to the reaction mixture, the reaction was carried out for 2 hours and, after further adding thereto 0.5 g of A.I.V.N., the reaction was carried out for 2 hours. After cooling, the reaction mixture was passed through a 200 mesh nylon cloth to obtain the desired latex grains having a mean grain size of 0.24 μm as a white dispersion.

Production Example 74 of Latex Grains: D-74

A mixed solution of 25 g of the dispersion-stabilizing resin P-7, 100 g of methyl methacrylate, 2 g of dodecyl acrylate, 0.8 g of n-dodecylmercaptan, and 688 g of Isopar H was heated to 60° C. with stirring under nitrogen gas stream and, after adding 0.7 g of A.I.V.N. to the reaction mixture, the reaction was carried out for 4 hours. After cooling, the reaction mixture was passed through a 200 mesh nylon cloth to obtain the desired latex grains having a mean grain size of 0.25 μm as a white dispersion.

Production Example 75 of Latex Grains: D-75

A mixed solution of 20 g of the dispersion-stabilizing resin P-14 having the formula shown below, 100 g of styrene, 2 g of octadecyl vinyl ether, and 380 g of Isopar H was heated to 45° C. with stirring under nitrogen gas stream and, after adding 1.0 g (as solid component) of a hexane solution of n-butyl lithium to the reaction mixture, the reaction was carried out for 4 hours. After cooling, the reaction mixture was passed through a 200 mesh nylon cloth to obtain the desired latex grains having a mean grain size of 0.28 μm as a white dispersion.

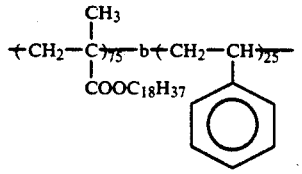

(P-14)

Weight average molecular weight: $8\times10^4$

Production Example 76 of Latex Grains: D-76

A mixed solution of 20 g of the dispersion-stabilizing resin P-15 having the formula shown below, and 470 g of n-dodecane was heated to 60° C. with stirring under nitrogen gas stream. Then, to the solution was added dropwise a mixed solution of 100 g of methyl methacrylate, 1.0 g of n-dodecylmercaptan and 0.8 g of A.I.V.N.

over 2 hours. After reacting for 2 hours, 0.3 g of A.I.V.N. was added to the mixture, followed by reacting for 2 hours. After cooling, the reaction mixture was passed through a 200 mesh nylon cloth in order to remove coarse grains to obtain the desired latex grains having a mean grain size of 0.25 μm as a white dispersion.

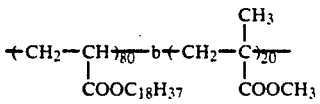

(P-15)

Weight average molecular Weight: $6\times10^4$

Production Example 77 of Latex Grains: D-77

A mixed solution of 16 g of the dispersion-stabilizing resin P-16 having the formula shown below, 100 g of vinyl acetate, 5 g of crotonic acid, 1.5 g of oxadecyl methacrylate and 468 g of Isopar E was heated to 70° C. with stirring under nitrogen gas stream and, after adding 0.8 g of A.I.V.N., the mixture was reacted for 6 hours. After elevating the temperature to 100° C., the mixture was stirred for 1 hour, and the remaining vinyl acetate was distilled off. After cooling, the reaction mixture was passed through a 200 mesh nylon cloth in order to remove coarse grains to obtain the desired latex grains having a mean grain size of 0.24 μm with a polymerization ratio of 85% as a white dispersion.

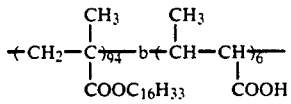

(P-16)

Weight average molecular weight: $3.3\times10^4$

Production Example 78 of Latex Grains: D-78

A mixed solution of 14 g of the dispersion-stabilizing resin P-17, 100 g of vinyl acetate, 6.0 g of 4-pentenoic acid and 380 g of Isopar G was heated to 75° C. with stirring under nitrogen gas stream and, after adding 0.7 g of A.I.V.N., the mixture was reacted for 4 hours and, after further adding thereto 0.5 g of A.I.V.N., the reaction was carried out for 2 hours. After cooling, the reaction mixture was passed through a 200 mesh nylon cloth in order to remove coarse grains to obtain the desired latex grains having a mean grain size of 0.23 μm as a white dispersion.

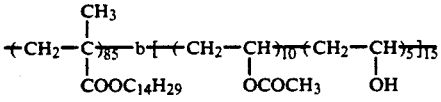

(P-17)

Production Example 79 of Latex Grains: Comparative Example E

By following the same procedure as Production Example 56 of latex grains D-56 except that a mixed solution of 20 g of poly(octadecyl methacrylate), 100 g of vinyl acetate, 1 g of octadecyl methacrylate, and 385 g of Isopar H was used in place of the mixture used in Production Example 56, latex grains having a mean grain size of 0.20 μm were obtained with a polymerization ratio of 85% as a white dispersion. (Latex grains disclosed in JP-A-60-179751)

Production Example 80 of Latex Grains: Comparative Example F

By following the same procedure as Production Example 56 of latex grains D-56 except that a mixed solution of 10 g of the dispersion-stabilizing resin R-1 used in Comparative Example B, 100 g of vinyl acetate, 1 g of Monomer (I) used in Comparative Example B and 385 g of Isopar H was used in place of the mixture used in Production Example 56, latex grains having a mean grain size of 0.24 μm were obtained with a polymerization ratio of 86% as a white dispersion. (Latex grains disclosed in JP-A-61-63855)

EXAMPLE 1

In a paint shaker (manufactured by Tokyo Seiki K.K.) were placed 10 g of a dodecyl methacrylate/acrylic acid copolymer (95/5 by weight ratio), 10 g of nigrosine, and 30 g of Shellsol 71 together with glass beads and they were dispersed for 4 hours to obtain a fine dispersion of nigrosine.

Then, a liquid developer for electrostatic photography was prepared by diluting 30 g of the latex grains D-1 obtained in Production Example 1 of latex grains, 2.5 g of the above-prepared nigrosine dispersion, 15 g of a higher alcohol, FOC-1400 (trade name, made by Nissan Chemical Industries, Ltd.) and 0.08 g of an octadecene-octadecylamide semi-maleate copolymer diluted with one liter of Shellsol 71.

Comparative Liquid Developers A and B

Two kinds of comparison liquid developers A and B were prepared in the same manner as above except that the resin dispersions (latex grains) shown below each was used in place of the latex grains D-1 used above.

Comparative Liquid Developer A

The latex grains obtained in Production Example 15 of latex grains were used.

Comparative Liquid Developer B

The latex grains obtained in Production Example 16 of latex grains were used.

An electrophotographic light-sensitive material, ELP Master II Type (trade name, made by Fuji Photo Film Co., Ltd.) was image-exposed and developed by a full-automatic processor, ELP 404V (trade name, made by Fuji Photo Film Co., Ltd.) using each of the liquid developers thus prepared. The processing (plate-making) speed was 5 plates/minute. Furthermore, after processing 2,000 plates of ELP master II Type, the occurrence of stains of the developing apparatus by sticking of the toner was observed. The blackened ratio (imaged area) of the duplicated images was determined using 30% original. The results obtained are shown in Table 9 below.

TABLE 9

| Test No. | Liquid Developer | Stains of Developing Apparatus | Image of the 2,000th Plate | Printing Durability | Remarks |
|---|---|---|---|---|---|
| 1 | Developer of Example 1 | No toner residue adhered. | Clear | More than 10,000 sheets | Invention |
| 2 | Comparative | Toner residue | Letter part lost, | 6,000 sheets | Comparative |

TABLE 9-continued

| Test No. | Liquid Developer | Stains of Developing Apparatus | Image of the 2,000th Plate | Printing Durability | Remarks |
|---|---|---|---|---|---|
| | Developer A | slightly adhered. | density of solid black lowered, background portion fogged. | | Example |
| 3 | Comparative Developer B | Toner residue adhered. | Fine lines slightly blurred. Dmax decreased. | 8,000 sheets | Comparative Example |

As is clear from the results shown in Table 9, when printing plates were produced by the above-described processing condition using each liquid developer, only the liquid developer of the present invention caused no staining of the developing apparatus and gave clear images of the 2,000th plate.

Then, the offset printing master plate (ELP Master) prepared using each of the liquid developers was used for printing in a conventional manner, and the number of prints obtained before the occurrences of defects of letters on the images of the prints, the blur of solid black portions, etc., was checked. The results showed that the master plate obtained by using the liquid developer of the present invention provided more than 10,000 prints without accompanied by the above-described failures, whereas the master plates obtained by using the liquid developers of Comparative Examples A and B showed the above-described failures on 6,000 prints and 8,000 prints, respectively.

As is clear from the above results, only the liquid developer according to the present invention could advantageously used for preparing a large number of prints by the master plate without causing stains on the developing apparatus by sticking of the toner.

When the liquid developers of Comparative Examples A and B were used under severe plate-making conditions (usually, the blackened ratio of the reproduced image at a plate-making speed of 2 to 3 plates per minute is about 8 to 10%), stains on the developing apparatus occurred, in particular, on the back surface of electrodes, and, after developing about 2,000 plates, the image quality of the reproduced image on the plate became to be adversely affected (e.g., decrease in Dmax, blurring of fine lines, etc.). Also, in Comparative Example A, the number of prints obtained by the master plate was markedly decreased.

The above results indicate that the resin grains according to the present invention are clearly excellent as compared with the comparative resins.

EXAMPLE 2

A mixture of 100 g of the white resin dispersion obtained in Production Example 2 of latex grains and 1.5 g of Sumikalon black was heated to 100° C. and stirred for 4 hours at the temperature. After cooling to room temperature, the reaction mixture was passed through a 200 mesh nylon cloth to remove the remaining dye, whereby a black resin dispersion having a mean grain size of 0.24 μm was obtained.

Then, a liquid developer was prepared by diluting 30 g of the above-prepared black resin dispersion, 0.05 g of zirconium naphthenate, and 20 g of a higher alcohol, FOC-1600 (trade name, made by Nissan Chemical Industries, Ltd.) with one liter of Shellsol 71.

When the liquid developer was applied to the same developing apparatus as in Example 1 for making printing plates, no occurrence of stains of the developing apparatus by sticking of the toner was observed even after developing 2,000 plates.

Also, the quantity of the offset printing master plate obtained was clear and also the image quality of the 10,000 prints formed using the master plate was very clear.

EXAMPLE 3

A mixture of 100 g of the white dispersion obtained in Production Example 13 of latex grains and 3 g of Victoria Blue B was heated to a temperature of from 70° C. to 80° C. with stirring for 6 hours. After cooling to room temperature, the reaction mixture was passed through a 200 mesh nylon cloth to remove the remaining dye, thereby a blue resin dispersion having a mean grain size of 0.23 μm was obtained.

Then, a liquid developer was prepared by diluting 32 g of the above-prepared blue resin dispersion, and 0.05 g of zirconium naphthenate with one liter of Isopar H.

When the liquid developer was applied to the same developing apparatus as in Example 1 for making printing plates, no occurrence of stains of the developing apparatus by sticking of the toner was observed even after developing 2,000 plates. Also, the image quality of the images on the offset printing master plate obtained was clear and also the image quality of the 10,000th print was very clear.

EXAMPLE 4

A liquid developer was prepared by diluting 32 g of the white dispersion obtained in Production Example 6 of latex grains, 2.5 g of the above-prepared nigrosine dispersion obtained in Example 1, 20 g of FOC-1400 (trade name, made by Nissan Chemical Industries, Ltd.) and 0.02 g of a semi-docosanylamidated compound of a diisobutylene/maleic anhydride copolymer with one liter of Isopar G.

When the liquid developer was applied to the same developing apparatus as in Example 1 for making printing plates, no occurrence of stains of the developing apparatus by sticking of the toner was observed even after developing 2,000 plates. Also, the image quality of the images on the offset printing master plate obtained was clear and also the image quality of the 10,000th print was very clear.

Furthermore, when the liquid developer was allowed to stand for 3 months and then the same processing as above was performed using the developer, the results were the same as those of the developer before storage.

EXAMPLE 5

In a paint shaker were placed 10 g of poly(decyl methacrylate), 30 g of Isopar H, and 8 g of Alkali Blue together with glass beads followed by dispersing them for 2 hours to obtain a fine dispersion of Alkali Blue.

Then, a liquid developer was prepared by diluting 30 g of the white resin dispersion D-5 obtained in Production Example 5 of latex grains, 4.2 g of the above-prepared Alkali Blue dispersion, 15 g of isostearyl alcohol, and 0.06 g of a semi-docosanylamidated compound of copolymer of diisobutylene and maleic anhydride with one liter of Isopar G.

When the liquid developer was applied to the same developing apparatus as in Example 1 for making printing plates, no occurrence of stains of the developing apparatus by sticking of the toner was observed even after developing 2,000 plates. Also, the image quality of the images on the offset printing master plate and the images of the 10,000th print was very clear.

EXAMPLES 6 TO 11

By following the same procedure as Example 5 except that each of the latex grains shown in Table 10 below was used in place of the white resin dispersion D-5, each of liquid developers of was prepared.

TABLE 10

| Example No. | Latex Grains |
|---|---|
| 6 | D-1 |
| 7 | D-2 |
| 8 | D-3 |
| 9 | D-4 |
| 10 | D-12 |
| 11 | D-13 |

When each liquid developer was applied to the same developing apparatus as in Example 1 for making printing plates, no occurrence of stains of the developing apparatus by sticking of the toner was observed even after developing 3,000 plates. Also, the image quality of each offset printing master plate observed and the images of the 10,000th print were very clear.

Furthermore, when the liquid developer was allowed to stand for 3 months and then the same processing as above was performed using the developer, the results were the same as those of the developer before storage.

EXAMPLE 12

In a paint shaker (manufactured by Tokyo Seiki K.K.) were placed 10 g of a copolymer of dodecyl methacrylate/acrylic acid (95/5 by weight ratio), 10 g of nigrosine, and 30 g of Isopar G together with glass beads followed by dispersing for 4 hours to obtain a fine dispersion of nigrosine.

Then, a liquid developer for electrostatic photography was prepared by diluting 30 g of the resin dispersion obtained in Production Example 17 of latex grains, 2.5 g of the above-prepared nigrosine dispersion, 15 g of FOC-1600 (trade name of tetradecyl alcohol, made by Nissan Chemical Industries, Ltd.) and 0.08 g of a copolymer of octadecene and octadecylamide semi-maleate, with one liter of Isopar G.

Comparative Liquid Developers C and D

Two kinds of comparative liquid developers C and D were prepared by following the above procedure using each of the following resin dispersions in place of the resin dispersion used above.

Comparative Liquid Developer C

The resin dispersion obtained in Production Example 54 of latex grains were used.

Comparative Liquid Developer D

The resin dispersion obtained in Production Example 55 of latex grains were used.

An electrophotographic light-sensitive material, ELP Master II Type (trade name, made by Fuji Photo Film Co., Ltd.) was imagewise-exposed and developed by a full-automatic processor, ELP 560 (trade name, made by Fuji Photo Film Co., Ltd.) using each of the liquid developers. The processing speed was 5 plates/minute. Furthermore, the occurrence of stains of the developing apparatus by sticking of the toners after processing 2,000 plates of ELP Master II Type was checked. The blackened ratio (imaged area) of the duplicated images was determined using 30% original. The results obtained are shown in Table 11 below.

TABLE 11

| Test No. | Liquid Developer | Stains of Developing Apparatus | Image of the 2,000th Plate | Remarks |
|---|---|---|---|---|
| 5 | Developer of Example 12 | No toner residue adhered. | Clear | Invention |
| 6 | Comparative Developer C | Toner residue greatly adhered. | Letter part lost, density of solid black lowered, background portion fogged. | Comparative Example C |
| 7 | Comparative Developer D | Toner residue adhered. | Fine lines slightly blurred. Dmax decreased. | Comparative Example D |

As is clear from the results shown in Table 11, when printing plates were produced by the above-described processing condition using each liquid developer, only the liquid developer of the present invention caused no staining of the developing apparatus and gave clear images of the 2,000th plate.

Then, the offset printing master plate (ELP Master) prepared using each liquid developer was used for printing in a conventional manner, and the number of prints obtained before the occurrences of defects of letters on the images of the prints, the blur of solid black portions, etc., was checked. The results showed that the master plate obtained by using each of the liquid developer of the present invention and the comparative liquid developers C and D provided more than 10,000 prints without accompanied by the above-described failures.

As is clear from the above results, only the liquid developer according to the invention could advantageously used for preparing a large number of prints by the master plate without causing stains on the developing apparatus by sticking of the toner.

When the liquid developers of Comparative Examples C and D were used under severe plate-making conditions (usually, the blackened ratio of the reproduced image at a plate-making speed of 2 to 3 plates per minute is about 8 to 10%), stains on the developing apparatus occurred, in particular, on the back surface of electrodes, and, after developing about 2,000 plates, the image quality of the reproduced image on the plate became to be adversely affected (e.g., decrease in Dmax, blurring of fine lines, etc.). Accordingly, these master plates were not practically useful due to deteriorated image quality of prints from the beginning of the printing.

The above results indicate that the resin grains according to the present invention are clearly excellent as compared with the comparative resins.

EXAMPLE 13

A mixture of 100 g of the white resin dispersion (D-18) obtained in Production Example 18 of latex grains and 1.5 g of Sumikaron Black was heated to 100° C. and stirred for 4 hours at that temperature. After cooling to room temperature, the reaction mixture was passed through a 200 mesh nylon cloth to remove the remaining dye, whereby a black resin dispersion having a mean grain size of 0.24 μm was obtained.

Then, a liquid developer was prepared by diluting 32 g of the above-described black resin dispersion, 0.05 g of zirconium naphthenate, and 20 g of hexadecyl alcohol, FOC-1600 (made by Nissan Chemical Industries, Ltd.) with one liter of Shellsol 71.

When the liquid developer was applied to the same developing apparatus as in Example 12 for making printing plates, no occurrence of stains of the developing apparatus by sticking of the toner was observed even after developing 2,000 plates.

Also, the image quantity of the offset printing master plate obtained was clear and the images of the 10,000th print were very clear.

EXAMPLE 14

A mixture of 100 g of the white resin dispersion (D-47) obtained in Production Example 49 of latex grains and 3 g of Victoria Blue B was heated to a temperature of from 70° C. to 80° C. followed by stirring for 6 hours. After cooling to room temperature, the reaction mixture was passed through a 200 mesh nylon cloth to remove the remaining dye, whereby a blue resin dispersion having a mean grain size of 0.25 μm was obtained.

Then, a liquid developer was prepared by diluting 32 g of the above-described blue resin dispersion, and 0.05 g of zirconium naphthenate with one liter of Isopar H.

When the liquid developer was applied to the same developing apparatus as in Example 12 for making printing plates, no occurrence of stains of the developing apparatus by sticking of the toner was observed even after developing 2,000 plates.

Also, the images of the offset printing master plate obtained were clear and the images of the 10,000th print were very clear.

EXAMPLE 15

A liquid developer was prepared by diluting 32 g of the white resin dispersion (D-22) obtained in Production Example 22 of latex grains, 2.5 g of the nigrosine dispersion prepared in Example 12, 20 g of tetradecyl alcohol, FOC-1400 (made by Nissan Chemical Industries, Ltd.) and 0.02 g of a semi-docosanylamidated compound of a copolymer of diisobutylene and maleic anhydride with one liter of Isopar G.

When the liquid developer was applied to the same developing apparatus as in Example 12 for making printing plates, no occurrence of stains of the developing apparatus by sticking of the toner was observed even after developing 2,000 plates.

Also, the image quality of the offset printing master plate obtained were clear and the images of the 10,000th print were very clear.

Furthermore, when the liquid developer was allowed to stand for 3 months and then used for the same processing as above, the results obtained were almost the same as above.

EXAMPLE 16

In a paint shaker were placed 10 g of poly(decyl methacrylate), 30 g of Isopar H, and 8 g of Alkali Blue together with glass beads followed by dispersing them for 2 hours to provide a fine dispersion of Alkali Blue.

Then, a liquid developer was prepared by diluting 30 g of the white resin dispersion (D-21) obtained in Production Example 21 of latex grains, 4.2 g of the above-prepared Alkali Blue, 15 g of isostearyl alcohol, and 0.06 g of a semi-docosanylamidated compound of copolymer of diisobutylene and maleic anhydride with one liter of Isopar G.

When the liquid developer was applied to the same developing apparatus as in Example 12 for making printing plates, no occurrence of stains of the developing apparatus by sticking of the toner was observed even after developing 2,000 plates. Also, the image quality of the images on the offset master plate and images of the 10,000th print were very clear.

EXAMPLES 17 TO 36

By following the same procedure as Example 16 except that each of the latex grains shown in Table 12 was used in place of the white resin dispersion (D-21) produced in Production Example 21 of latex grains, each of liquid developers was prepared.

TABLE 12

| Example No. | Latex Grains | Example No. | Latex Grains |
|---|---|---|---|
| 17 | D-17 | 27 | D-28 |
| 18 | D-18 | 28 | D-29 |
| 19 | D-19 | 29 | D-32 |
| 20 | D-20 | 30 | D-36 |
| 21 | D-21 | 31 | D-37 |
| 22 | D-22 | 32 | D-40 |
| 23 | D-23 | 33 | D-41 |
| 24 | D-24 | 34 | D-43 |
| 25 | D-25 | 35 | D-44 |
| 26 | D-26 | 36 | D-46 |

When each of the liquid developer was applied to the developing apparatus as in Example 12, no occurrence of stains of the developing apparatus by sticking of the toner was observed even after developing 2,000 plates.

Also, the image quality of each offset printing master plate obtained and the images of the 10,000th prints obtained in each case were very clear.

Furthermore, when the liquid developer was allowed to stand for 3 months and the used for the same processing as above, the results obtained were almost the same as above.

EXAMPLE 37

In a paint shaker (manufactured by Tokyo Seiki K.K.) were placed 10 g of a dodecyl methacrylate/acrylic acid copolymer (95/5 by weight ratio), 10 g of nigrosine, and 30 g of Shellsol 71 together with glass beads followed by dispersing for 4 hours to obtain a fine dispersion of nigrosine.

Then, a liquid developer was prepared by diluting 30 g of the resin dispersion (D-56) produced in Production Example 56 of latex grains, 2.5 g of the above-prepared nigrosine dispersion, 15 g of tetradecyl alcohol, FOC-1400 (made by Nissan Chemical Industries, Ltd.) and 0.08 g of a copolymer of octadecene and octadecylamide semi-maleate with one liter of Shellsol 71.

Comparative Liquid Developers E and F

Two kinds of comparative liquid developers E and F were prepared in the same manner as above except that each of the resin dispersions (latex grains) shown below was used in place of the above resin dispersion.

Comparative Liquid Developer E

The resin dispersion obtained in Production Example 79 of latex grains were used.

Comparative Liquid Developer F

The resin dispersion obtained in Production Example 80 of latex grains were used.

The resulting liquid developers were evaluated in the same manner as in Example 12, and the results obtained are shown in Table 13 below.

TABLE 13

| Example No. | Liquid Developer | Stains of Developing Apparatus | Image of the 2,000th Plate | Printing Durability |
|---|---|---|---|---|
| Example 43 | Developer of Example 37 | No toner residue adhered. | Clear | more than 10,000 sheets |
| Comparative Example E | Comparative Developer E | Toner residue markedly adhered. | Letter part lost, density of solid black lowered, background portion fogged. | 8,000 sheets |
| Comparative Example F | Comparative Developer F | Toner residue adhered. | Fine lines slightly blurred. Dmax decreased. | 8,000 sheets |

As is clear from the results shown in Table 13, when printing plates were produced by the above-described processing condition using each liquid developer, the only liquid developer of the present invention caused no stains of the developing apparatus and gave the 2,000th printing plate having clear images.

Then, the offset printing master plate (ELP Master) prepared using each liquid developer was used for printing in a conventional manner, and the number of prints obtained before the occurrences of defects of letters on the images of the prints, the blur of solid black portions, etc., was checked. The results showed that the master plate obtained using the liquid developer of the present invention provided more than 10,000 prints without accompanied by the above-described failures, whereas the master plates obtained by using the liquid developers of Comparative Example E and F showed the above-described failures on 8,000 prints.

As is clear from the above results, the only liquid developer according to the present invention could advantageously used for preparing a large number of prints by the master plate without causing stains on the developing apparatus by sticking of the toner.

When the liquid developers of Comparative Examples E and F were used under severe plate-making conditions (usually, the blackened ratio of the reproduced image at a plate-making speed of 2 to 3 plates per minutes is about 8 to 10%), stains on the developing apparatus occurred, in particular, on the back surface of electrodes, and, after developing about 2,000 plates, the image quality of the reproduced image on the plate became to be adversely affected (e.g., decrease in Dmax, blurring of fine lines, etc.).

The above results indicate that the resin grains according to the present invention are clearly excellent as compared with the comparative resins.

EXAMPLE 38

A mixture of 100 g of the white resin dispersion D-57 obtained in Production Example 57 of latex grains and 1.5 g of Sumikalon Black was heated to 100° C. followed by stirring for 4 hours. After cooling, the reaction mixture was passed through a 200 mesh nylon cloth to remove the remaining dye, whereby a black resin dispersion having a mean grain size of 0.24 μm was obtained.

Then, a liquid developer was prepared by diluting 32 g of the above-described black resin dispersion, 0.05 g of zirconium naphthenate, and 20 g of FOC-1600 (hexadecyl alcohol made by Nissan Chemical Industries, Ltd.) with one liter of Shellsol 71.

When the resulting liquid developer was applied to the developing apparatus as in Example 12 for making printing plates, no occurrence of stains of the developing apparatus by sticking of the toner was observed even after developing 2,000 plates.

Also, the image quantity of the offset printing master plate obtained was clear and images of the 10,000th prints were very clear.

EXAMPLE 39

A mixture of 100 g of the white resin dispersion D-77 obtained in Production Example 77 of latex grains and 3 g of Victoria Blue was heated to a temperature of from 70° C. to 80° C. followed by stirring for 6 hours. After cooling to room temperature, the reaction mixture was passed through a 200 mesh nylon cloth to remove the remaining dye, whereby a blue resin dispersion having a mean grain size of 0.23 μm was obtained.

Then, a liquid developer was prepared by diluting 32 g of the above-described blue resin dispersion, and 0.05 g of zirconium naphthenate with one liter of Isopar H.

When the resulting liquid developer was applied to the developing apparatus as in Example 12, no occurrence of stains of the developing apparatus by sticking of the toner was observed even after developing 2,000 plates.

Also, the image quality of the offset printing master plate obtained was clear and the images of the 10,000th print was were clear.

EXAMPLE 40

A liquid developer was prepared by diluting 32 g of the white resin dispersion D-61 obtained in Production Example 61 of latex grains, 1.5 g of the nigrosine dispersion obtained in Example 37, 20 g of FOC-1400 (tetradecyl alcohol made by Nissan Chemical Industries, Ltd.) and 0.02 g of a semi-docosenylamidated compound of an isobutylene/maleic anhydride copolymer with one liter of Isopar G.

When the resulting liquid developer was applied to the developing apparatus as in Example 12, no occurrence of stains of the developing apparatus by sticking of the toner was observed even after developing 2,000 plates.

Also, the image quality of the offset printing master plate obtained was clear and the images of the 10,000th print was were clear.

Furthermore, when the liquid developer was allowed to stand for 3 months and used for the processing as above, the results obtained were almost the same as above.

EXAMPLE 41

In a paint shaker were placed 10 g of poly(decyl methacrylate), 30 g of Isopar H, and 8 g of Alkali Blue together with glass beads followed by dispersing for 2 hours to prepare a fine dispersion of Alkali Blue.

Then, a liquid developer was prepared by diluting 30 g of the white resin dispersion D-60 obtained in Production Example 60 of latex grains, 4.2 g of the above-prepared Alkali Blue dispersion, 15 g of FOC-1400 (isostearyl alcohol made by Nissan Chemical Industries, Ltd.), and 0.06 g of a semi-docosanylamidated product of copolymer of diisobutylene and maleic anhydride with one liter of Isopar G.

When the liquid developer was applied to the developing apparatus as in Example 12 for making printing plates, no occurrence of stains of the developing apparatus by sticking of the toner was observed even after developing 2,000 plates.

Also, the image quality of the offset printing master plate obtained and the images of the 10,000th print was very clear.

EXAMPLES 42 TO 47

By following the same procedure as Example except that each of the latex grains shown in Table 14 below was used in place of the white resin dispersion D-60 obtained in Production Example 60 of latex grains, each of liquid developers was prepared.

TABLE 14

| Example No. | Latex Grains |
|---|---|
| 42 | D-56 |
| 43 | D-57 |
| 44 | D-58 |
| 45 | D-62 |
| 46 | D-66 |
| 47 | D-68 |

When each of the liquid developer was applied to the same developing apparatus as in Example 12 for making printing plates, no occurrence of stains of the developing apparatus by sticking of the toner was observed even after developing 2,000 plates.

Also, the image quality of the offset printing master plate obtained and the images of the 10,000th print were very clear.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising at least resin grains dispersed in a non-aqueous solvent having an electric resistance of at least $10^9$ Ωcm and a dielectric constant of not higher than 3.5, wherein the dispersed resin grains are polymer resin grains obtained by polymerizing a solution containing at least one mono-functional monomer (A) which is soluble in said non-aqueous solvent but becomes insoluble therein by being polymerized, in the presence of a dispersion-stabilizing resin soluble in said non-aqueous solvent, which is an AB block copolymer having a weight average molecular weight from $1\times10^4$ to $5\times10^5$ composed of an A block containing at least a polymer component represented by the general formula (I) described below and a B block comprising a polymer component containing at least one polar group selected from a carboxy group, a sulfo group, a hydroxyl group, a formyl group, an amino group, a phosphono group and a

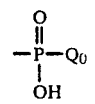

group (wherein $Q_0$ represents $-Q_1$ or $-OQ_1$ (wherein $Q_1$ represents a hydrocarbon group) and/or a polymer component corresponding to the monofunctional monomer (A):

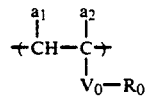

(I)

wherein $V_0$ represents —COO—, —OCO—, $-(CH_2)_l-COO-$, $-(CH_2)_lOCO-$ or —O— (wherein l represents an integer of from 1 to 3), $R_0$ represents an aliphatic group having 10 or more carbon atoms, and $a_1$ and $a_2$, which may be the same or different, each represents a hydrogen atom, a halogen atom, a cyano group, a hydrocarbon group, $-COO-D_1$ or $-COO-D_2$ bonded via a hydrocarbon group (wherein $D_1$ represents a hydrogen atom or a hydrocarbon group which may be substituted).

2. The liquid developer for electrostatic photography as in claim 1, wherein the dispersed resin grains are copolymer resin grains obtained by polymerizing a solution containing at least one mono-functional monomer (A) which is soluble in the non-aqueous solvent but becomes insoluble therein by being polymerized and at least one monomer (B-1) represented by the following formula (III), said monomer (B-1) having at least two polar groups and/or polar linkage groups;

$$-(A_1-B_1)_r-(A_2-B_2)_s-E \quad \text{(III)}$$

wherein U represents

—O—, —COO—, —OCO—, $-CH_2OCO-$, $-SO_2-$,

-continued $$-CONH-,\ -SO_2NH-,\ -\overset{\overset{E_1}{|}}{C}ON-,\ \text{or}\ -SO_2\overset{\overset{E_1}{|}}{N}-$$

(wherein $E_1$ represents a hydrocarbon group or has the same meaning as the $-(A_1-B_2)_r(A_2-B_2)_sE$ in the linkage group of formula (III)); E represents a hydrogen atom or a hydrocarbon group having from 1 to 18 carbon atoms, which may be substituted with a halogen atom, —OH, —CN, $-NH_2$, —COOH, $-SO_3H$, or $-PO_3H_2$; $B_1$ and $B_2$, which may be the same or different, each represents $$-O-,\ -S-,\ -CO-,\ -CO_2-,\ -OCO-,\ -SO_2-,$$

$$-\overset{\overset{E_2}{|}}{N}-,\ -\overset{\overset{E_2}{|}}{C}ON-,\ -\overset{\overset{E_2}{|}}{N}CO-,\ -\overset{\overset{E_2}{|}}{N}SO_2-,\ -SO_2\overset{\overset{E_2}{|}}{N}-,$$

$$-NHCO_2-\ \text{or}\ -NHCONH-$$

(wherein $E_2$ has the same meaning as E described above); $A_1$ and $A_2$, which may be the same or different, each represents a hydrocarbon group having from 1 to 18 carbon atoms which may be substituted or may contain $$-\underset{\underset{B_3+A_4-B_4\rightarrow_t E_3}{|}}{CH}-$$

(wherein $B_3$ and $B_4$, which may be the same or different, have the same meaning as $B_1$ and $B_2$ described above; $A_4$ represents a hydrocarbon group having from 1 to 18 carbon atoms, which may be substituted; and $E_3$ has the same meaning as E) in the main chain bond; $e_1$ and $e_2$, which may be the same or different, each represents a hydrogen atom, a hydrocarbon group, —COO—$E_4$ or —COO—$E_4$ bonded via a hydrocarbon group (wherein $E_4$ represents a hydrogen atom or a hydrocarbon group which may be substituted); and r, s and t, which may be the same or different, each represents an integer of from 0 to 4, provided that r, s and t cannot be 0 at the same time, in the presence of said dispersion-stabilizing resin.

3. A liquid developer for electrostatic photography as claimed in claim 2, wherein a content of the monomer (B-1) is from 0.1 to 10% by weight based on the amount of the monomer (A) used.

4. The liquid developer for electrostatic photography as in claim 1, wherein the dispersed resin grains are copolymer resin grains obtained by polymerizing a solution containing at least one mono-functional monomer (A) which is soluble in the non-aqueous solvent but becomes insoluble therein by being polymerized and at least one monomer (B-2) represented by the following formula (IV), said monomer (B-2) having an aliphatic group having at least 8 carbon atoms and forming a copolymer by the polymerization reaction with said monomer (A);

$$\overset{\overset{e_3}{|}}{CH}=\overset{\overset{e_4}{|}}{C}-\underset{\underset{U-E_1}{|}}{} \qquad \text{(IV)}$$

wherein $E_1$ represents an aliphatic group having at least 8 carbon atoms; U represents $$-COO-,\ -CONH-,\ -\overset{\overset{E_2}{|}}{C}ON-$$

(wherein $E_2$ represents an aliphatic group), —OCO—, $-CH_2COO-$, or —O—; and $e_3$ and $e_4$, which may be the same or different, each represents a hydrogen atom, an alkyl group, $-COOE_3$, or $-CH_2COOE_3$ (wherein $E_3$ represents an aliphatic group), in the presence of said dispersion-stabilizing resin.

5. The liquid developer for electrostatic photography as in claim 1, wherein said mono-functional monomer (A) is represented by the formula (II):

$$\overset{\overset{b_1}{|}}{CH}=\overset{\overset{b_2}{|}}{C}-\underset{\underset{V_1-R_1}{|}}{} \qquad \text{(II)}$$

wherein $V_1$ represents $$-COO-,\ -OCO-,\ -CH_2OCO-,\ -CH_2COO-,$$

$$-O-,\ -CONHCOO-,\ -CONHOCO-,\ -SO_2-,$$

$$-\overset{\overset{D_2}{|}}{N}CON-,\ -SO_2\overset{\overset{D_2}{|}}{N}-,\ \text{or}$$

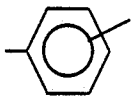

(wherein $D_2$ represents a hydrogen atom or an aliphatic group having from 1 to 8 carbon atoms), $R_1$ represents an aliphatic group having from 1 to 6 carbon atoms, and $b_1$ and $b_2$, which may be the same or different, each represents a hydrogen atom, a halogen atom, a cyano group, a hydrocarbon group, —COO—$D_1$ or —COO—$D_2$ bonded via a hydrocarbon group (wherein $D_1$ represents a hydrogen atom or a hydrocarbon group which may be substituted).

6. The liquid developer for electrostatic photography as in claim 1, wherein the proportion of the A block to the B block in said AB block copolymer is from 99/1 to 50/50 by weight.

7. The liquid developer for electrostatic photography as in claim 1, wherein said AB block copolymer has a weight average molecular weight of from $2\times10^4$ to $1\times10^5$.

8. The liquid developer for electrostatic photography as in claim 1, wherein said dispersion-stabilizing resin is used in an amount of from 1 to 100 parts by weight per 100 parts by weight of the mono-functional monomer (A).

9. A liquid developer for electrostatic photography as claimed in claim 8, wherein a content of the monomer (B-2) is from 0.1 to 20% by weight based on the amount of the monomer (A) used.

10. A liquid developer for electrostatic photography as claimed in claim 1, wherein the liquid developer further contains a coloring agent.

* * * * *